United States Patent [19]

Nagato

[11] Patent Number: 5,063,394

[45] Date of Patent: Nov. 5, 1991

[54] THERMAL RECORDING APPARATUS AND PRINT HEAD

[75] Inventor: Hitoshi Nagato, Kawasaki, Japan

[73] Assignee: Kabushiki Kaisha Toshiba, Kawasaki, Japan

[21] Appl. No.: 385,091

[22] Filed: Jul. 26, 1989

[30] Foreign Application Priority Data

Jul. 26, 1988 [JP] Japan ..... 63-184511
May 17, 1989 [JP] Japan ..... 1-123604

[51] Int. Cl.[5] ..... B41J 2/325; B41J 2/38; B41J 2/39

[52] U.S. Cl. ..... 346/76 PH; 400/120

[58] Field of Search ..... 346/76 PH; 400/120

[56] References Cited

U.S. PATENT DOCUMENTS 4,704,616 11/1987 Nakamura ..... 346/76 PH
4,781,113 11/1988 Yamamoto et al. ..... 346/76 PH
4,825,040 4/1989 Kato ..... 346/76 PH

FOREIGN PATENT DOCUMENTS 0214971 9/1987 Japan ..... 400/120
63-179767 7/1988 Japan .

*Primary Examiner*—Benjamin R. Fuller
*Assistant Examiner*—Huan H. Tran
*Attorney, Agent, or Firm*—Oblon, Spivak, McClelland, Maier & Neustadt

[57] ABSTRACT

In a thermal recording head, a glazed layer is formed on a substrate, a resistive layer is formed on the glazed layer. A common electrode is formed on the resistive layer and separate electrodes are formed on the resistive layer in such a manner that the end portion of the separate electrodes are closely arranged at the end portion of the common electrode with a gap therebetween and the separate electrodes are extended in parallel on the resistive layer. A wear-resistant layer is formed on the resistive layer and the common and separate electrodes exept the end portions of the common and separate electrodes. In a thermal recording head, the end portions of the common and separate electrodes are contacted to a current injection type ink ribbon in a current injection mode so that a current flows through the first current path in the resistance layer between the common and separate electrodes and a second current path in the ink ribbon between the common and separate electrodes.

65 Claims, 15 Drawing Sheets

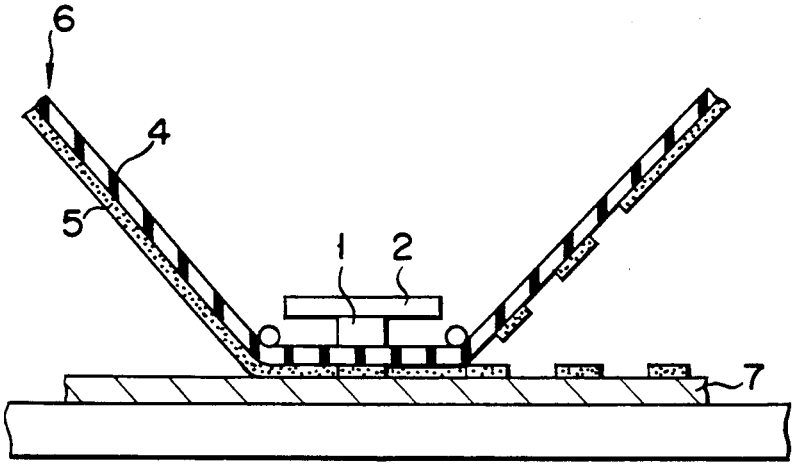
FIG. 2
FIG. 3A
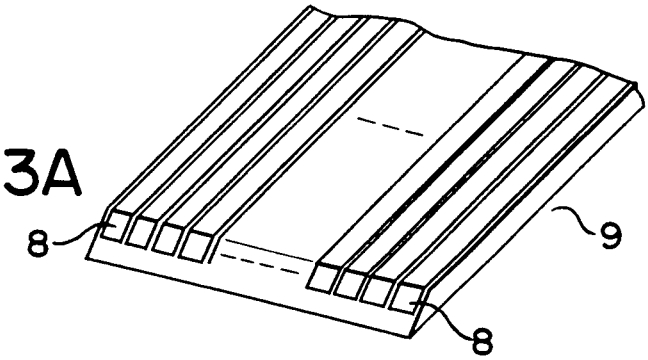
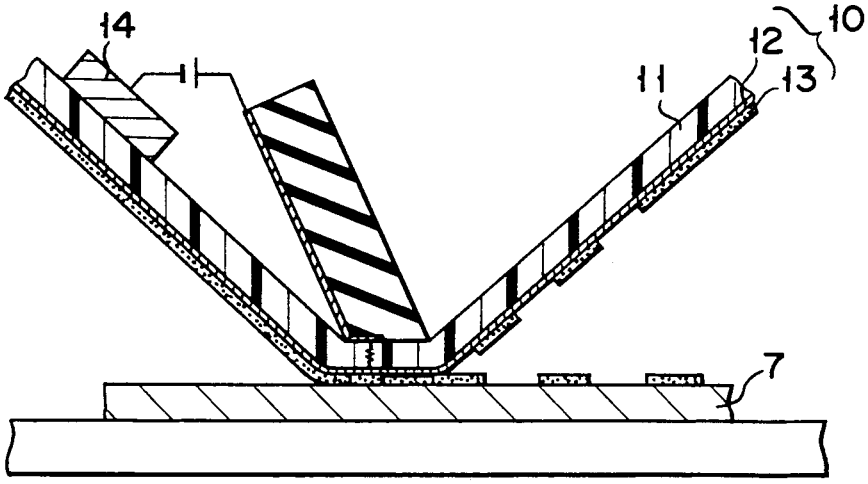
FIG. 3B

THERMAL RECORDING APPARATUS AND PRINT HEAD

BACKGROUND OF THE INVENTION

1. Field of the Invention

The present invention relates a thermal recording print head and a thermal recording apparatus incorporating the same. Thermal recording apparatuses are nonimpact type recording apparatuses, and hence generate small noise. In addition, they are easy to maintain. Because of these advantages, these apparatuses are widely used as output terminal apparatuses of OA equipment such as portable wordprocessors. The thermal recording apparatuses are classified into three types, i.e., thermal paper recording apparatuses, thermal ink transfer recording apparatuses, and current injection thermal recording apparatuses. These thermal recording apparatuses will be briefly described below with reference to FIGS. 1A to 3B.

FIGS. 1A and 1B illustrate a thermal paper recording apparatus. As shown in FIG. 1A, the thermal paper recording apparatus employs a thermal head 2 having an array of a large number of resistive elements 1 for generating heat. In a recording mode, the thermal head 2 is urged against thermal paper 3 as shown in FIG. 1B, and currents are selectively supplied to the resistive elements 1 on the thermal head 2 in accordance with a recording pattern. As is known, the thermal paper 3 is special paper which is designed such that its heated portion is color-developed. The thermal paper 3 is color-developed by Joule heat generated by the resistive elements 1 to which the currents are supplied, and an image is formed. The thermal paper recording apparatus is characterized in that apparatuses cost is low because it has the simplest structure among the three types of thermal recording apparatuses, recording cost is low because thermal paper is not very expensive although it is special paper, and a recording speed is high because reciprocal recording can be performed. In contrast to this, the thermal paper recording apparatus has some problems. For example, only thermal paper can be used for recording, images recorded on thermal paper are difficult to retain for a long period of time because the paper easily reacts to friction, light, and the like, and a recording on thermal paper is alterable.

Thermal ink transfer recording apparatuses are designed to eliminate the drawbacks of the thermal paper recording apparatuses. FIG. 2 illustrates a thermal ink transfer recording apparatus. The thermal ink transfer recording apparatus employs a thermal head 2 having the same structure as that of the thermal head of the thermal paper recording apparatus, and an ink ribbon 6 including a base film 4 and an ink layer 5 coated with ink which is softened and melted or sublimated by heating one surface of the base film 4. In a recording mode, the thermal head 2 is urged against the other surface of the base film 4 of the ink ribbon 6 as shown in FIG. 2, the ink layer 5 is urged against recording paper 7, and currents are selectively supplied to resistive elements 1 on the thermal head 2. When the ink of the ink layer 5 is softened and melted or sublimated due to Joule heat generated by the heat resistive elements 1, the ink is transferred onto the recording paper 7 to form an image. The thermal ink transfer recording apparatus is advantageous in that the drawbacks of the thermal paper recording apparatus are eliminated. More specifically, plain paper can be used as the recording paper 7, long-term retention of images recorded is possible, and is not alterable. In comparison with thermal paper, however, an ink ribbon cost is several times more, and only one-way recording can be performed.

FIGS. 3A and 3B illustrate a current injection type thermal recording apparatus. Similar to the thermal ink transfer recording apparatus, the current injection type thermal recording apparatus is a recording apparatus which forms an image by softening and melting or sublimating ink coated on an ink ribbon and transferring the ink onto recording paper. However, it is different from the thermal ink transfer recording apparatus in that the ink ribbon itself generates the heat.

As shown in FIG. 3A, the current injection type thermal recording apparatus employs a recording head 9 on which recording electrodes 8 are aligned. An ink ribbon 10 consists of a resistive base film 11, a conductive layer 12 formed on the film 11, and an ink layer 13 formed on the layer 12. When the recording head 9 and a return electrode 14 are urged against the ink ribbon 10, and a voltage is selectively applied to the recording electrodes 8, a current flows from the corresponding recording electrodes 8 to the return electrode 14 through the resistive base film 11 and the conductive layer 12. Joule heat is generated in the ink ribbon 10 when the current flows through the base film 11. Since the contact area of the return electrode 14 with the ink ribbon 10 is much larger than that of the recording electrode 8, heat producing a temperature which is large enough to melt the ink layer 13 is generated only in a region of the ink ribbon 10 which is in contact with the recording electrode 8, and an image is formed on recording paper 7 at a portion corresponding to this region.

In comparison with the thermal ink transfer recording apparatus, in the current injection type thermal recording apparatus, since heat is generated very near the ink layer 13, the generated heat can be efficiently transmitted to the ink. In addition, since the thermal ink transfer recording apparatus employs a thermal head, accumulation of heat in the thermal head, damage to the thermal head due to heat, and the like must be considered. In contrast to this, in the current injection type thermal recording apparatus, since the recording head itself is not heated, accumulation of heat in the head is small, and the recording head is free from damage even if recording energy is increased. Therefore, in the current injection type thermal recording apparatus, a recording speed can be increased as compared with the thermal ink transfer recording apparatus.

Furthermore, in the thermal ink transfer recording apparatus, although recording can be performed on plain paper, the quality of an image on paper having a rough surface is degraded. In contrast to this, since the current injection type thermal recording apparatus can generate large recording energy, high-speed recording can be performed on rough paper by using ink having a high melting point which is adapted to record information on rough paper.

As described above, the thermal recording apparatuses of the three recording schemes have their own specific characteristic features. The thermal paper recording apparatus is used for a facsimile apparatus; the thermal ink transfer type recording apparatus, for a wordprocessor; and the current injection type thermal recording apparatus, for a rough paper printer. In this manner, they are used in fields in which their characteristic features can be effectively applied. As will be described below, however, a recording apparatus having the contradictory characteristic features of these thermal apparatuses is sometimes required.

The recording costs per A4-size paper of the respective schemes will be compared with each other. Currently available A4 size thermal paper cost is about 10 yen. The recording cost per a character of the thermal ink transfer recording apparatus is about 3/100 yen, and that of the current injection type thermal recording apparatus is about 7/100 to 8/100 yen, respectively as ink ribbon costs. Therefore, a recording cost of about 300 characters or more per A4-size paper in the thermal ink transfer recording apparatus and that of about 150 characters or more per A4-size paper in the current injection type thermal recording apparatus exceed the cost of A4-size thermal paper. If fine characters are required special paper which has a smooth surface must be used (this cost is about five yen), in the thermal ink transfer apparatus. In consideration of this point, recording of 150 characters or more in the thermal thermal ink transfer recording apparatus will cost more than thermal paper recording. Note that since long-term retention of images recorded on thermal paper is not possible at a room temperature, thermal paper is not suitable for recording a document which should be kept for a long period of time. Recently, however, since a copy service cost as about 10 yen by a plain paper copier is available, a document output on thermal paper may be copied to retain for a long period of time.

When all theses points are taken into consideration, thermal paper recording is advantageous for recording of about 500 characters or more per A4-size paper, and thermal ink transfer or current injection recording is advantageous for recording of less than 500 characters per A4-size paper.

The above conclusion is obtained in terms of only recording costs. However, quality of characters has recently attracted a great deal of attention. Since the thermal ink transfer and current injection type recording apparatuses use ink, they can record fine characters with high contrast as compared with recording using thermal paper. In addition, the current injection type recording apparatus is superior to the thermal ink transfer type recording apparatus since it can record fine characters regardless of a type of recording paper, and can perform recording at a higher speed. Therefore, it is ideal that recording schemes are changable in accordance with application purposes in a same thermal recording apparatus. A portable wordprocessor is one of such recording apparatus which is expected to be able to use for various purposes. It may be used personally for a variety of purposes, and may be used in different manners depending on the occupation of a user. As described above, when recording of a document of about 500 characters or less, e.g., a general notification or the like is to be performed, the thermal ink transfer or current injection type thermal recording apparatus can be advantageously used in favor of recording cost. In contrast to this, technical/special documents, such as theses and reports, usually include 500 characters or more per A4-size paper. Thermal paper recording is advantageous for such a document. If about 1,600 characters can be recorded on a sheet of A4-size paper, the recording cost of thermal paper recording is about $\frac{1}{3}$ that of other recording schemes.

Most of the currently available portable wordprocessors employ the thermal ink transfer recording apparatus. Since the thermal ink transfer recording apparatus employs a thermal head, it can also be used for thermal paper recording if an ink ribbon is not used. Therefore, when, for example, recording cost is taken into consideration, thermal paper recording and thermal thermal ink transfer recording may be switched depending on the number of characters to be recorded. In this case, however, fine characters cannot be recorded on general plain paper (PPC paper and the like) or rough paper which has a rough surface. In contrast to this, if the current injection type thermal recording apparatus is used as a recording apparatus of a wordprocessor, recording on paper having a rough surface can be performed. In this case, however, since the structure of the recording head of the apparatus is different from that of the apparatuses of other recording schemes, it cannot be used for thermal ink transfer or thermal paper recording apparatus, and recording on especially thermal paper of low cost cannot be performed.

SUMMARY OF THE INVENTION

It is an object of the present invention to provide a thermal recording head which can be used for any of three recording schemes, i.e., thermal paper, thermal ink transfer recording, and current injection thermal recording schemes in a recording apparatus such as a wordprocessor which has a variety of application purposes and conditions, and a thermal recording apparatus which can select these three recording schemes in suiting purposes by using this thermal recording head.

According to the present invention, there is provided a thermal recording apparatus capable of recording on either of thermal paper or plain paper in accordance with recording data. The apparatus comprise hold means for holding first and second ribbons. The first and second ink ribbons is detached from the hold means in a thermal paper recording mode for performing recording on plain paper. One of the first and second ink ribbons is attached to the hold means in first and second thermal thermal ink transfer recording modes for performing recording on plain paper by transferring ink from one of the first and second ink ribbons. The first ink ribbon includes a base film and an ink layer which is formed on the base film and transferred onto plain paper upon reception of heat and the second ink ribbon includes a resistive base film. The first ink ribbon preferably includes a conductive layer which may be formed on the base film and allows a current to pass therethrough. An ink layer is formed on the conductive layer of the base film, which is transferred onto plain paper upon reception of heat generated in the resistive base film. The one of the first and second ink ribbons held by the hold means is feeded by a feeding means in a predetermined direction. The apparatus further comprises heat generating means, having heating points for generating heat in accordance with recording data, for applying heat from the heating points to thermal paper in the a thermal paper recording mode, the heat generating means being brought into contact with the first ink ribbon in the first heat transfer recording mode to apply heat from first ink ribbon heating points to the first ink ribbon and current supply means which has electrodes each for supplying a current in accordance with recording data and is brought into contact with the second ink ribbon in the second heat transfer recording mode so as to supply a current to the second ink ribbon and to generate heat in the resistive base film of the second ink ribbon. The heat generating means is located at an upstream side of the current supply means with respect to the predetermined direction in which one of the first and second ink ribbons is fed.

According to the invention, there is also provided a thermal recording head for applying heat to thermal paper in a thermal paper recording mode, applying heat to a first ink ribbon in a first heat transfer recording mode, and applying a current to a second ink ribbon in a second heat transfer recording mode. The head comprises a substrate, a resistive layer formed on said substrate; a common electrode having one end portion formed on said resistive layer, a large number of separate electrodes formed on said resistive layer near one end portion of said common electrode, each having one end portion spaced apart from one end portion of said common electrode by a predetermined gap, and separately extending on said resistive layer. Said separate electrodes defines a first current path extending from said separate electrodes to said common electrode through said resistive layer and a second current path extending from said separate electrodes to said common electrode through said second ink ribbon. A first wear-resistant layer is formed on said resistive layer within the gap. A heat generated in said resistive layer in the first current path is applied to one of thermal paper and said first ink ribbon through said wear-resistance layer.

BRIEF DESCRIPTION OF THE DRAWINGS

FIGS. 1A and 1B, FIG. 2, and FIGS. 3A and 3B are views for explaining the operation principles of conventional thermal paper, thermal ink transfer, and current injection thermal ink transfer recording;

DETAILED DESCRIPTION OF THE PREFERRED EMBODIMENTS

Figure 1A:
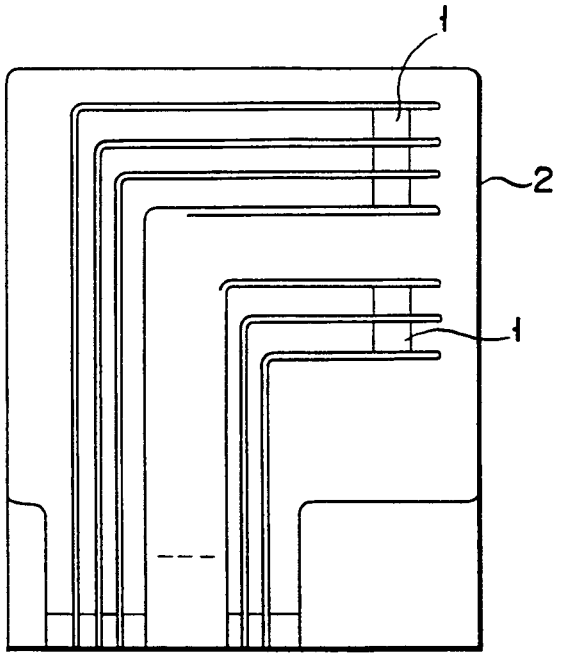
Figure 1B:
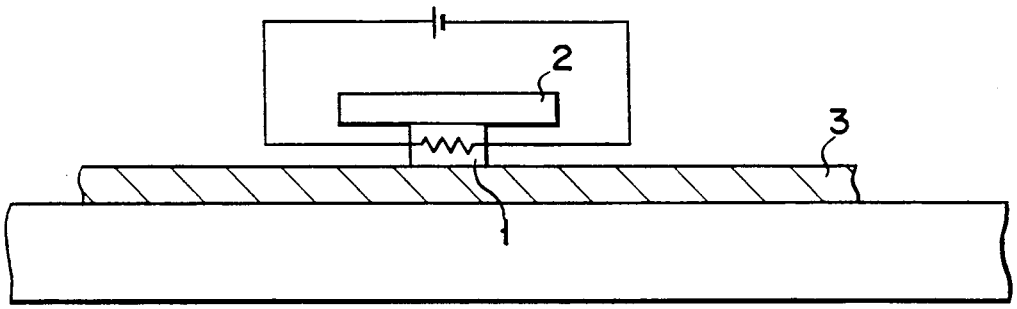
Figure 4:
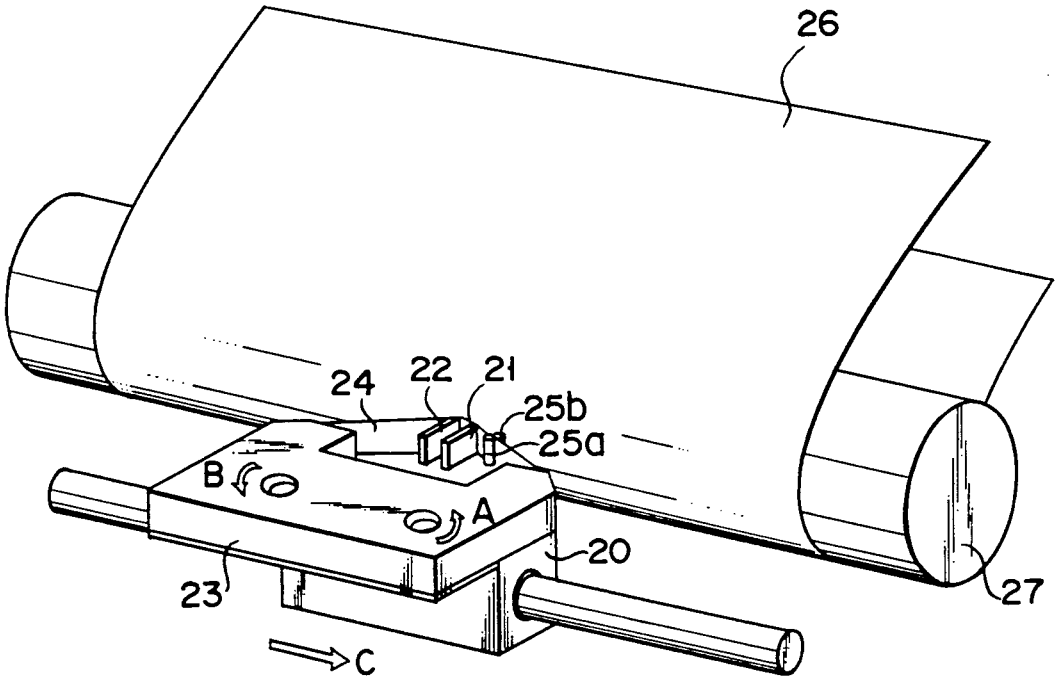
FIG. 4 is a perspective view showing a schematic mechanism of a recording section of a thermal recording apparatus of the present invention.

An embodiment of the present invention will be described below with reference to the accompanying drawings. FIG. 4 shows a schematic mechanism of a recording section of a serial type thermal recording apparatus according to an embodiment of the present invention. A thermal ink transfer recording head 21 for generating heat and applying it to an ink ribbon, and a current injection type thermal recording head 22 for injecting a current into an ink ribbon to generate heat therein are mounted on a carriage 20. In addition, an ink ribbon 24 for thermal ink transfer type or for current injection type thermal recording is stored in an ink ribbon cassette 23 on the carriage 20. The ink ribbon 24 is taken up by a pair of take-up rollers 25A and 25B. More specifically, the ink ribbon 24 is fed from a supply reel (not shown) as indicated by an arrow A, and a portion of the ink ribbon 24 which is fed from the supply reel is taken up by a take-up reel (not shown) as indicated by an arrow B. One of the pair of ribbon taken-up rollers 25A and 25B, e.g., the roller 25A also serves as a return electrode which is brought into contact with a resistive base film of the ink ribbon 24 so as to collect currents flowing through the conductive layer of the ink ribbon 24. This return electrode 25A is made of a metal and connected to the ground potential. The thermal ink transfer recording head 21 is set on the upstream side of the current injection type thermal recording head 22 with respect to the moving direction of the ink ribbon 24. With this arrangement, during thermal thermal ink transfer recording in which heat is generated and applied to the ink ribbon 24, and ink is transferred from the ink ribbon 24 onto recording paper 26, the recording head 22 serves as a separating bar for separating the ink ribbon 24 from the recording paper 26. In addition, during current injection recording in which a current is injected to the ink ribbon 24 to generate heat therein and ink is transferred from the ink ribbon 24 onto the recording paper 26, if pre-heat is applied from the upstream recording head 21 to the ink ribbon 24 and the preheated ink ribbon 24 is supplied to the downstream recording head 22, the ink can be reliably transferred onto the recording paper 26 by a relatively small energy. When the carriage 20 is moved in a direction indicated by an arrow C, an image is recorded on the recording paper 26. When the carriage 26 is moved in the opposite direction, a platen 27 feeds the recording paper 26 by a necessary amount without recording an image. The thermal head 21 and the current injection type thermal recording head 22 are urged against the platen 27 through the recording paper 26 prior to the start of a recording operation, and are released upon completion of recording operation. The thermal head 21 and the recording head 22 may be independently urged and released. In this embodiment, however, they are simultaneously urged and released. Since they are simultaneously urged and released in this manner, urging and releasing mechanisms can be simplified, and at the same time the recording head 22 can be used as a separating bar for separating the ink ribbon 24 from the recording paper 24 during thermal thermal ink transfer recording. For this purpose, the thermal head 21 and the recording head 22 are separated from each other by a proper distance. This distance is defined such that the ink ribbon 24 travels during a time interval between the instant when ink is heated and the instant when the ink ribbon 24 is separated from recording paper. Known end face type heads are respectively used as the thermal head 21 and the recording head 22 in this embodiment.

Figure 5:
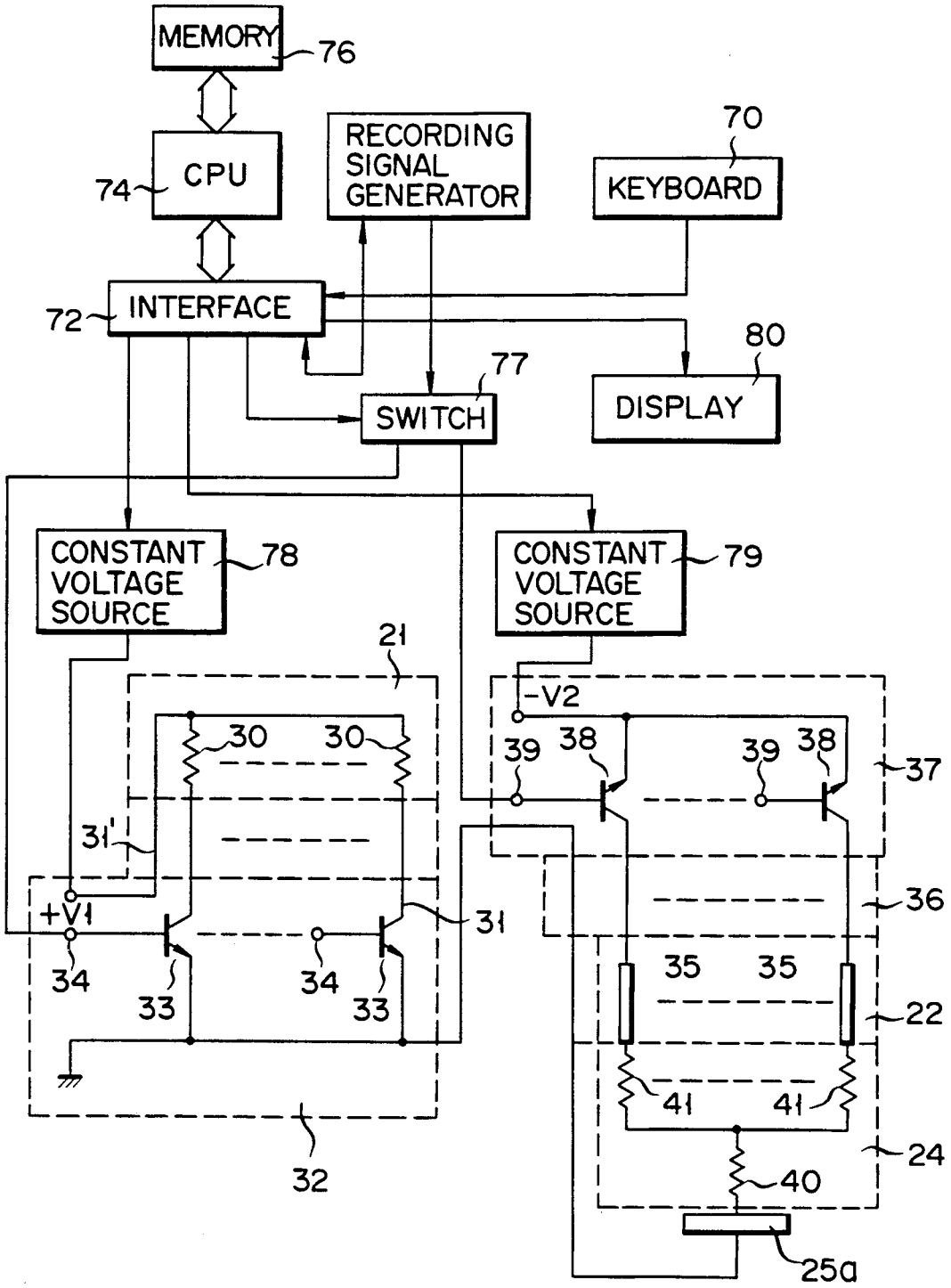
FIG. 5 is a block diagram showing a circuit for driving the thermal recording apparatus in FIG. 4.

The thermal head 21 and the current injection type thermal recording head 22 are connected to an external driver circuit through signal cables (not shown). The heat resistive elements of the thermal head 21 and the recording electrodes of the recording head 22 are driven by this external driver circuit. FIG. 5 shows a driver circuit and an electrical equivalent circuit for driving the thermal head 21 and the recording head 22.

Thermal paper recording for recording an image on thermal paper and thermal thermal ink transfer recording for transferring ink from an ink ribbon onto plain paper by applying heat to the ink ribbon will described first. A large number of heat resistive elements 30 are formed on the thermal head 21. Each heat resistive element 30 is connected to a driver transistor 33 on a driver circuit 32 through a connecting cable 31', as shown in FIG. 5. A drive voltage +V1 for driving each heat resistive element 30 is applied to the driver circuit 32 and is applied to the common terminal of the heat resistive elements 30 through the connecting cable 31. When a recording voltage is selectively applied to a base terminal 34 of a corresponding one of the driver transistors 33 in accordance with an image to be recorded, a current flows in only one of the selected heat resistive elements 30. As a result, this heat resistive element 30 is heated.

Current injection recording will be described below. In this recording, a current is supplied to an ink ribbon, and an ink is transferred from the ink ribbon onto plain paper because of heat generated in the ink ribbon. A large number of recording electrodes 35 are formed on the current injection type thermal recording head 2. Each recording electrode 35 is connected to a driver transistor 37 on a driver circuit 37 through a connecting cable 36. A drive voltage V2 for driving each recording electrode 35 is applied between a return electrode 25A and the common terminal of driver transistors 38. In this embodiment, since the return electrode 25A is maintained at the ground potential, a voltage of −V2 is applied to the common terminal of the driver transistors 38. The ground potential is applied to the return electrode 25A through the connecting cable 36. When a recording voltage is selectively applied to a base terminal 39 of a corresponding one of the driver transistors 38 in accordance with an image to be recorded, a current flows from the return electrode 25A to only a selected resistive layer 41 of a resistive ink ribbon 24 through a common resistor 40 of the ink ribbon 24.

In the above-described thermal recording apparatus, when thermal paper recording is to be performed, a thermal paper recording mode is designated through a keyboard 70, and a thermal paper recording mode signal is supplied to a CPU 74 through an interface 72, while no ink ribbon cassette is attached. The CPU 74 reads out a thermal paper recording program from a memory 76 in a predetermined sequence in accordance with this thermal paper recording mode. More specifically, a first switching signal is supplied from the CPU 74 to a switch 77 through the interface 72, and a recording signal generator 78 for generating a recording signal is connected to the driver circuit 32 through the switch 77. At the same time, the recording signal generator 78 and a constant-voltage driver 78 are driven in response to an energizing signal, thus executing thermal paper recording. Execution steps to this thermal paper recording are displayed on a display 80 in response to display signals from the CPU 74. In contrast to this, when thermal thermal ink transfer recording is to be performed, after the ink cassette ribbon 23 is loaded, a thermal thermal ink transfer recording mode is designated through the keyboard 70, and a thermal ink transfer recording mode signal is supplied to the CPU 74 through the interface 72. The CPU 74 reads out a thermal ink transfer recording program from the memory 76 in a predetermined sequence in accordance with this thermal ink transfer recording mode. More specifically, a second switching signal is supplied from the CPU 74 to the switch 77 through the interface 72, and the recording signal generator 78 for generating a recording signal is connected to the driver circuit 37 through the switch 77. At the same time, the recording signal generator 78 and a constant-voltage driver 79 are operated in response to an energizing signal from the CPU 74, thus executing thermal ink transfer recording. Execution steps of this thermal ink transfer recording are displayed on the display 80 in response to display signals from the CPU 74.

As described above, in the current injection recording mode, after the ink ribbon cassette for current injection recording is attached to the carriage 20, only the driver circuit 37 is operated. However, both the driver circuits 32 and 37 may be driven. In this case, a current which has not sufficient level to soften the ink may flow in resistive elements of the thermal head 21 to warm the ink ribbon. Generally, the softening point of the ink of the current injection type is higher than the thermal paper point of the thermal paper or softening point of the thermal ink transfer type ink, i.e., the softening point of the current injection type is about 100° to 120° C., the softening point of the thermal ink transfer is about 65° to 75° C. The pre-heating energy is preferably about half of the energy applied to the thermal head in the thermal ink transfer mode, since heat applied to the ink is generated in the ink ribbon in the current injection mode and the heat is applied to the ink ribbon from the outside in the thermal ink transfer mode. With this pre-heating operation, the ink ribbon is pre-heated for current injection recording so that current injection recording can be further increased in speed or the recording voltage −V2 can be decreased.

In the above-described embodiment, constant voltage drivers are employed as the constant voltage sources 78 and 79. However, a constant voltage driver and a constant current driver may be respectively employed as the constant-voltage drivers 78 and 79. In addition, in the above-described embodiment, a current flows from the return electrode 25A to the recording electrode 22 side. However, a voltage may be reversal applied to cause a current to flow from the recording electrode 22 to the return electrode 25A.

Modifications and other embodiments of the present invention will be described below.

In the first embodiment described with reference to FIG. 5, the recording schemes can be switched by an input from the keyboard 70. However, the respective recording schemes may be automatically determined and switched by a thermal recording apparatus itself.

Figure 6:
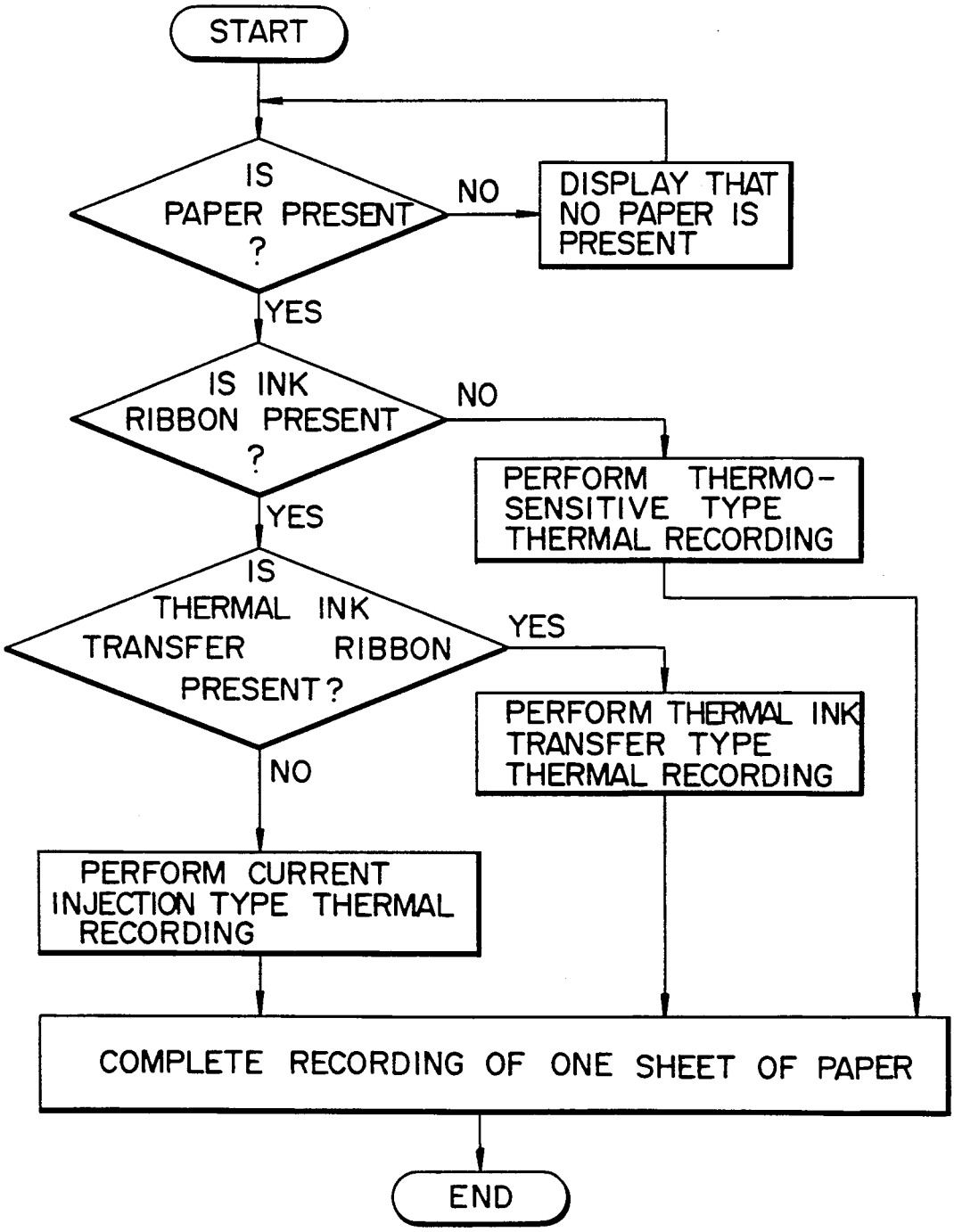
FIG. 6 is a flow chart for explaining an operation of discriminating thermal paper, thermal ink transfer type, and current injection type thermal recording schemes in the circuit in FIG. 5.

A recording operation of a recording apparatus employing such a recording system will be described with reference to a flow chart shown in FIG. 6. Upon reception of a command for starting a recording operation from a keyboard 70, a CPU 74 determines the presence/absence of recording paper in accordance with signals from sensors 50 shown in FIG. 7 which are connected to an interface 72. This operation serves to prevent damage to a head due to heat upon energization in a "no paper" state or to prevent recording on a platen. If no recording paper is present, the CPU 74 supplies a display signal to a display 80 to display the absence of recording paper. While no recording paper is present, the CPU 74 is set in a standby state until the next recording signal is output. If recording paper is prepared, the CPU 74 determines the presence/absence of an ink ribbon in accordance with signals from the sensors 51 and 52 shown in FIG. 7 which are connected to the interface 72. Since the absence of ink ribbon means that thermal paper is prepared, thermal paper recording is executed in response to an energizing signal from the CPU 74. Since the presence of an ink ribbon means that an ink ribbon for thermal ink transfer recording or an ink ribbon for current injection recording is set, the CPU 74 determines which one of the following ink ribbons is set in accordance with signals from the sensors 51 and 52. If a thermal ink transfer type ink ribbon is set, a current flows in the thermal head side in response to an energizing signal from the CPU 74 to execute thermal ink transfer recording. Similarly, if a current injection type ink ribbon is set, a current flows in a current injection type head in response to an energizing signal from the CPU 74 to execute current injection recording.

Figure 7:
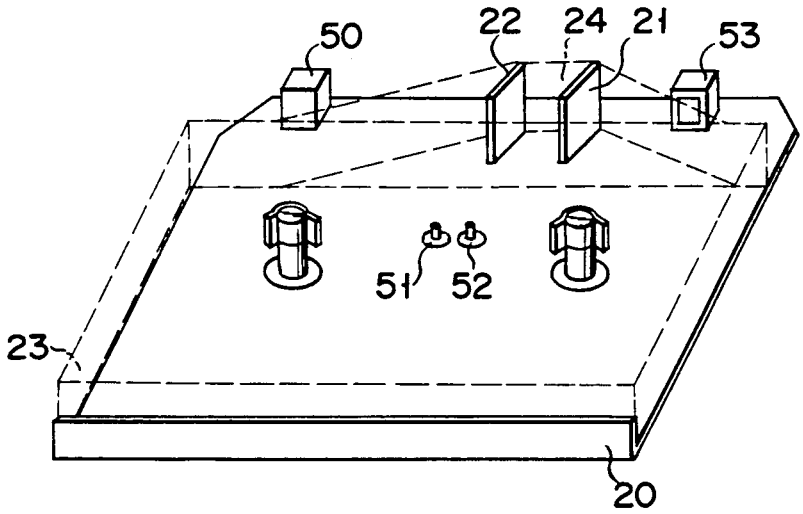
FIG. 7 is a view showing an arrangement of sensors for discriminating the recording schemes in the thermal recording apparatus in FIG. 4.

The above-described various types of sensors will be described below with reference to FIG. 7. A paper sensor 50, the ribbon cassette sensors 51 and 52, a ribbon end sensor 53, a thermal head 21 and current injection type recording head 22 are mounted on a carriage 20. The paper sensor 50 detects attachment of paper to a platen. The ribbon cassette sensors 51 and 52 detect attachment of a ribbon cassette 23 to the carriage 20. The sensor 53 detects running out of a ribbon. Note that the ink ribbon cassette 23 and an ink ribbon 24 are set as indicated by broken lines in FIG. 7. For example, the paper sensor 50 can be realized by a reflection type optical sensor or the like. Since a platen is normally black, light emitted from an light-emitting portion of the sensor 50 is scarcely reflected by the platen to be received by a light-receiving portion. In contrast to this, if recording paper is inserted, an intensity of reflected light is increased. Therefore, a high intensity of light is reflected and received by the light-receiving portion of the sensor 50, thus detecting the presence/absence of recording paper. Note that if a transparent sheet such as an OHP sheet is to be used as recording paper, a mode is set in advance to neglect an output from the paper sensor 50. Such an operation can be realized by using a mechanical sensor as the paper sensor 50.

Figure 8A:
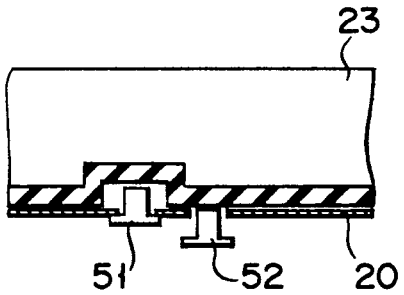
FIGS. 8A and 8B are sectional views showing the structures of cartridges corresponding to the sensors in FIG. 7.
Figure 8B:
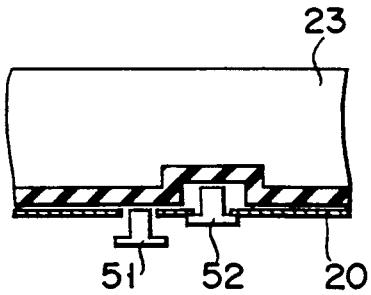

The presence/absence of a ribbon cassette and a type of ink ribbon are discriminated by the ribbon cassette sensors 51 and 52. In this embodiment, for example, the ribbon cassette sensors 51 and 52 are constituted by mechanical push bottom switches. One of recesses shown in FIGS. 8A and 8B is formed in the lower surface of the ribbon cassette 23 at a position corresponding to the sensor 51 or 52. A recess which is denoted by a reference numeral 51 in FIG. 8A is formed in the lower surface of a ribbon cassette for, e.g., thermal ink transfer recording. A recess which is denoted by reference numeral 52 in FIG. 8B is formed in the lower surface of a ribbon cassette for current injection recording at the right side of the sensor 51. Push bottoms of the sensors 51 and 52 are normally pushed upward by springs or the like. When the push bottoms are depressed, conductors below the push bottoms are short-circuited to generate detecting signals. According to a sensor having the above-described structure, an ink ribbon can be identified in accordance with the position of the recess of the ribbon cassette 23. If, for example, the state of a closed switch is represented by "0", and the state of an open switch is represented by "1", outputs are obtained from the sensors 51 and 52 in accordance with the presence/absence of an ink ribbon and a type of ink ribbon as shown in Table 1, thus determining a corresponding recording scheme.

TABLE 1

| Sensor 51 | Sensor 52 | presence/absence of Cassette | Type of recording |
|---|---|---|---|
| 1 | 1 | absent | thermal paper recording |
| 1 | 0 | present | thermal ink transfer recording |
| 0 | 1 | present | current injection recording |

The ribbon end sensor 53 is a sensor for detecting the end of an ink ribbon and is constituted by, e.g., an optical sensor. This sensor is used to prevent execution of a recording operation in a state wherein an ink ribbon is used up. If, for example, a tape on which aluminum having a high reflectivity or the like is deposited is attached to the end portion of an ink ribbon, the end of the ink ribbon can be detected.

The above-described method of determining a recording scheme is just an example, and the present invention is not limited to this. In this embodiment, since the presence/absence of a cassette and a type of ink ribbon are determined by using the ribbon cassette sensors 51 and 52, the two sensors 51 and 52 are required. However, if only the presence/absence of a cassette is to be detected, only one sensor may be used. In this case, an ink ribbon for current injection recording can be discriminated in the following manner. A current injection type recording head is urged against an ink ribbon, and a current having a low level (too low for execution of recording) flows in a given recording electrode or a detecting electrode. At this time, if a current flows in this electrode, it is determined that an ink ribbon for current injection recording is loaded in the cassette 23. If no current flows, it is determined that an ink ribbon for thermal ink transfer recording is loaded in the cassette 23.

Figure 9:
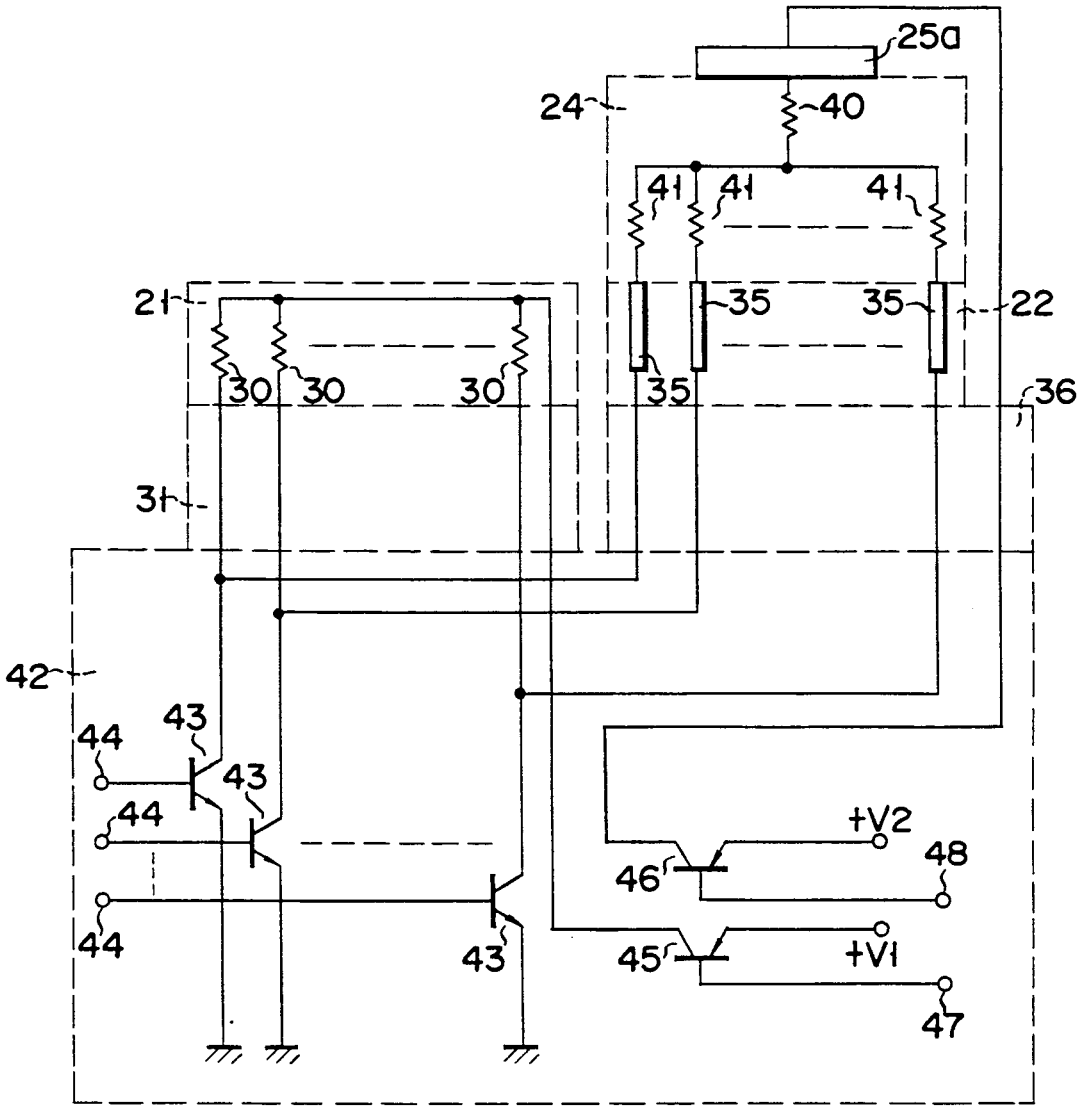
FIGS. 9 and 10 are circuit diagrams showing a circuit for driving the thermal recording apparatus in FIG. 4 according to another embodiment of the present invention.
Figure 10:
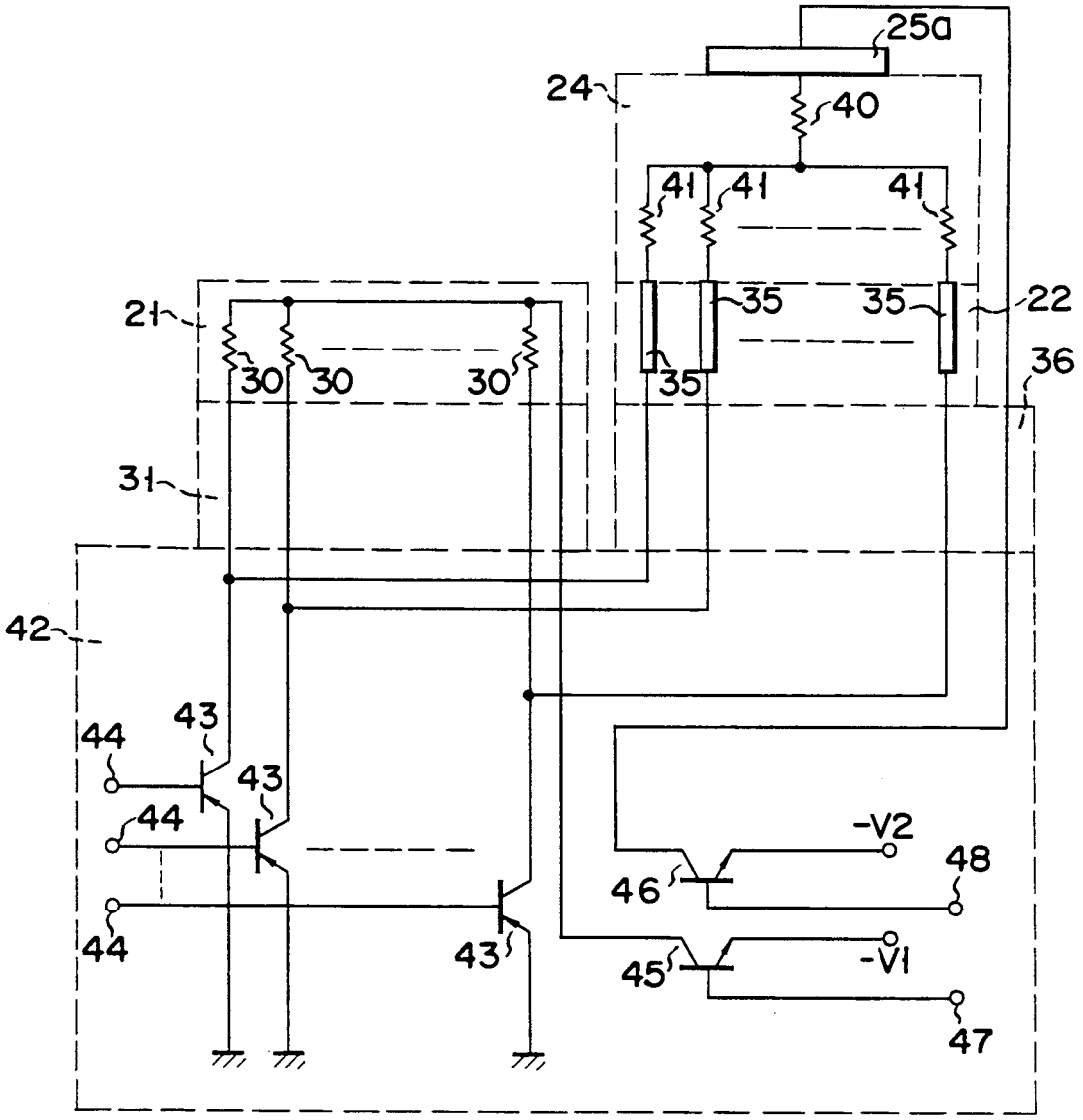

In the first embodiment, the two driver circuits, i.e., the driver circuit 32 for thermal ink transfer recording and the driver circuit 37 for current injection recording are required. In a third embodiment, a thermal head 21 and a current injection type recording head 22 are driven by a single driver circuit. FIG. 9 shows a circuit for driving the thermal head 21 and the current injection type recording head 22 by using a single driver circuit 42. In the driver circuit 42, the collector terminals of driver transistors 43 are respectively connected to heating resistive elements 30 and recording electrodes 35. In addition, the collectors of switching transistors 45 and 46 for respectively selecting a thermal head and a current injection type recording head are connected to the common terminal of the heating resistive elements 30 of the thermal head 21 and a return electrode 25A of the current injection type recording head 22. A thermal head selecting signal 47 and a current injection type recording head selecting signal 48 are respectively supplied to the bases of the switching transistors 45 and 46. Recording voltages +V1 and +V2 as recording signals are applied to the emitters of the transistors 45 and 46. A recording voltage is selectively applied to the base terminal 44 of one of the driver transistors 43 in accordance with image data. If, for example, the thermal head selecting signal 47 is output at this time, the voltage +V1 is applied to the common terminal of the thermal head through the switching transistor 45 for thermal ink transfer recording. As a result, a current selectively flows in a corresponding one of the heating elements 30 in accordance with an image signal, thereby executing thermal paper recording or thermal ink transfer recording. If, for example, the current injection recording selecting signal 48 is output, the voltage +V2 is applied to the return electrode through the switching transistor 46 for current injection recording. In this case, a current selectively flows in a corresponding one of the recording electrodes 35 in accordance with an image signal, and current injection recording is executed. In this manner, currents can selectively flow in the thermal head 21 and the current injection type recording head 22 by using only the single driver circuit 42. Note that FIG. 10 shows a modification of the circuit shown in FIG. 9. A circuit shown in FIG. 10 is substantially the same as that shown in FIG. 9, but is different therefrom in that negative voltages are applied to the collectors of transistors 46 and 45, and the direction of a current flowing in the circuit is opposite to that in the circuit shown in FIG. 9.

As described in the first embodiment, in current injection recording, a pre-heat effect due to a thermal head may be used. In this case, the thermal head selecting signal 47 and the current injection type recording head selecting signal 48 are simultaneously output to apply the voltages +V1 and +V2 to the common terminal of the thermal head and the return electrode 25A for current injection recording, respectively, thereby simultaneously driving the thermal head and the recording electrode. When the thermal head and the recording electrodes 35 are to be simultaneously driven in the circuit shown in FIG. 9, diodes must be inserted between all the recording electrodes 35 and the driver circuits 43, and between all the heating resistive elements 30 and the driver circuits 43 so as to allow currents to flow toward the driver circuits 43. In the circuit shown in FIG. 9, the recording voltages +V1 and +V2 are different from each other. However, if thermal paper recording, thermal ink transfer recording, and current injection recording can be executed by using the same voltage, the recording voltages +V1 and +V2 may be set to be equal to each other. In contrast to this, if the recording sensitivity of thermal paper recording is different from that of thermal ink transfer recording, recording voltages for thermal paper and thermal ink transfer recording must be independently applied to the common terminal of the thermal head. In addition, in the circuit shown in FIG. 9, the constant voltages V2 and V1 are applied from the constant-voltage drivers. However, the respective heating resistive elements and recording electrodes may be driven by constant-current drivers. Moreover, in the above embodiment, the number of heating resistive elements 30 on the thermal head 21 is equal to that of recording electrodes of the current injection type recording head 22. However, the present invention can be applied to a case wherein these numbers are different from each other. In this case, the number of driver circuits 43 to be prepared is set to be equal to that of elements which are larger in number than the other elements.

Figure 11:
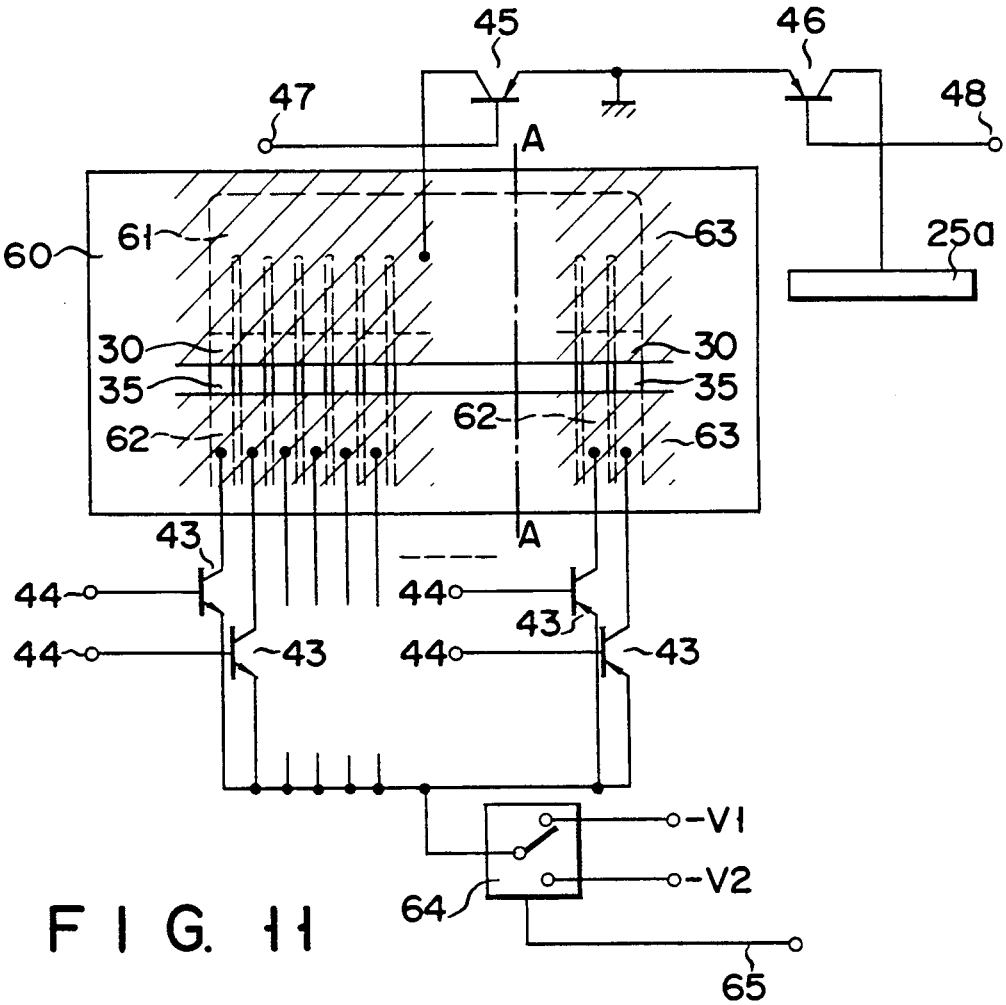
FIGS. 11 to 16 are plan and sectional views each showing a thermal head structure in which a thermal head and a current injection type thermal recording head are formed on one bodyment.
Figure 12:
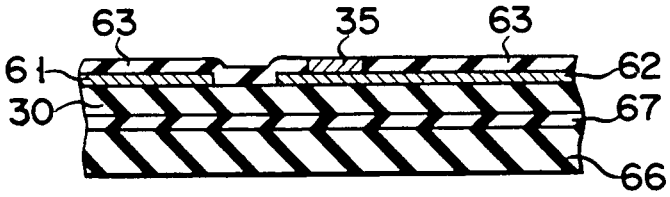

In the first to third embodiments described above, the two recording heads, i.e., the thermal head 21 and the current injection type recording head 22 are used. If two recording heads are used, two signal cables must be connected between the recording heads and an external circuit. A fourth embodiment in which a thermal head and a current injection type recording head are formed on a single recording head will be described below. FIGS. 11 and 12 show a recording head 60 having heating resistive elements 30 (indicated by dot line in FIG. 11) and recording electrodes 35 are formed in series between a common electrode 61 and separate electrodes 62. According to the recording head having such an arrangement, the heating resistive elements 30 are formed under the common electrode 61, as shown in FIG. 12. Although the recording electrodes 35 may be made of the same material as that of the common electrode 61 or the separate electrode 61, at least portions corresponding to the recording electrodes 35 are preferably made of a wear-resistant material such as tungsten because they are brought into direct contact with an ink ribbon. A wear-resistant/insulating layer 63 (indicated by a hatched portion in FIG. 11) is formed on the conductors and the heating resistive elements 30 except on recording electrode 35 so as to prevent direct contact of the elements 30, common electrode 61 and separate electrode from an ink ribbon. A resistive layer 30 is formed on a glazed layer 67 which is formed on a substrate 66. In addition, the common electrode 61 and the separate electrodes 62 are formed on the resistive layer 30. In a normal thermal head, a heat-resistant/insulating layer 63 is also formed. In the recording head according to the present invention, however, the heat-resistant/insulating layer 63 is not formed on a portion corresponding to the recording electrodes 35. After the heat-layer 63 is formed in this manner, a metal material having high wear resistance is embedded in the portion corresponding to the recording electrodes 35 by metal deposition or plating, thus completing the recording head.

A driver circuit for driving the recording head 60 shown in FIG. 11 has substantially the same arrangement as that of the driver circuit shown in FIG. 9. In the driver circuit shown in FIG. 9, the voltages +V1 and +V2 are respectively applied to the common electrode 61 side of the thermal head and the return electrode 25A (for current injection recording). In contrast to this, in the driver circuit shown in FIG. 11, the ground voltages are applied to both the common electrode 61 and the return electrode 25A due to the following reason. Since the return electrode 25A is arranged to be exposed as shown in FIG. 4, an operator may receives an electric shock if a voltage other than the ground voltage is applied. If the return electrode 25A is designed to prevent direct contact therewith, the driving method shown in FIG. 9 may be employed. Since the common electrodes in both the circuits are set at the common potential, if the voltage at the emitter terminal of a driver transistor 43 is switched to a voltage −V1 or −V2 by supplying a voltage switching signal 65 to an analog switch 64 or the like, a driver circuit similar to the circuit in FIG. 9 can be realized. When thermal paper recording or thermal ink transfer recording is to be performed by using such a recording head, a thermal head selecting signal 47 is output first, and the ground voltage is applied to the common electrode 61 of the head. At the same time, the analog switch 64 is connected to the voltage −V1 side in response to the voltage switching signal 65, and the voltage −V1 is applied to the emitter terminal of a corresponding one of the driver transistors 43. When a voltage is selectively applied to a base terminal 44 of the driver transistor 43, a current flows in only a selected one of the heating resistive elements 30, thus executing thermal paper recording or thermal ink transfer recording. When current injection recording is to be performed, a current injection recording selecting signal 48 is output first, and the ground voltage is applied to the return electrode 25A. At the same time, the analog switch 64 is connected to the voltage −V2 in response to the voltage switching signal 65, and the voltage −V2 is applied to the emitter terminal of a corresponding one of the driver transistors 43. When a voltage is selectively applied to the base electrode 44 of the driving transistor 43 in accordance with an image signal, a current flows from the return electrode 25A to only a selected one of the recording electrodes 35 through an ink ribbon, thus executing current injection recording.

In this embodiment, the voltages −V1 and −V2 are also switched in accordance with a recording scheme. If the sensitivities of thermal paper and ink, the resistance of each heating resistive element, the resistance of current injection recording, and the like are properly adjusted, power sources need not be switched. In this case, the emitter electrode of each driver transistor 43 is only required to be connected to a constant negative power source. In this case, current supplied to the ink ribbon is decreased so that the performance of the current injection recording is lowered, if a load resistance of the resistive layer of the ink ribbon between return electrode 25A and recording electrode 35 is sufficiently smaller than the resistance of the heat generating resistive layer, since the resistive layer of the ink ribbon is connected in parallel with the heat resistive layer in the current injection mode. Accordingly, it is necessary that the load resistance of the resistive layer of the ink ribbon is designed to have a half of the resistance of the heat generating resistive layer, pre-ferably 1/5 of the heat generating resistance layer. Furthermore, the preheating operation can be obtained by a leakage current produced in the heat generating resistive layer, when the heat generating elements are arranged in the upstream side of the recording electrode 35 with respect to the direction of moving of the ink ribbon.

Figure 13:
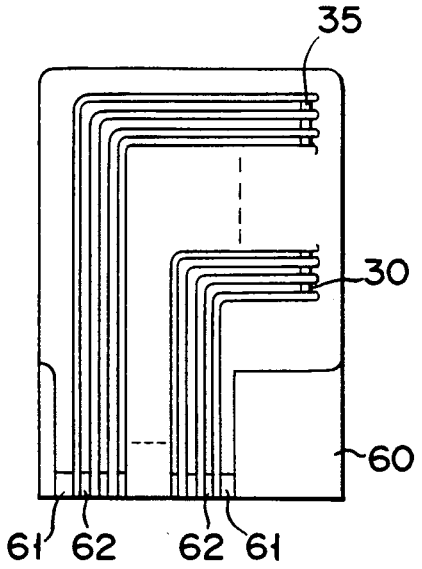
Figure 14:
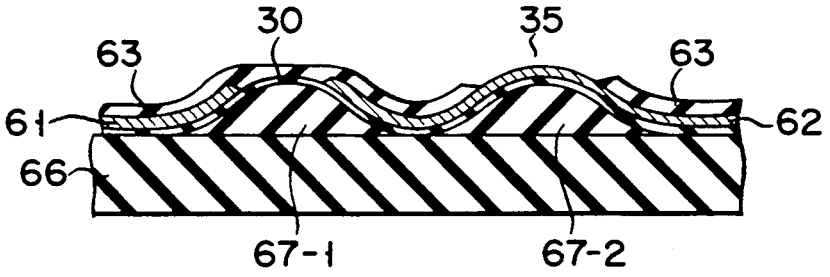

FIGS. 13 and 14 show a recording head according to still another embodiment of the present invention. Heating resistive elements 30 and recording electrodes 35 are formed on a recording head 60 at a resolution of 8 dots/mm so as to respectively constitute 24 dots. A common electrode 61 and separate electrodes 62 are arranged on the recording head as shown in FIG. 13 and are connected to a driver circuit through flexible cables (not shown). FIG. 14 shows another embodiment of a kind of a recording head shown in FIG. 12. A thermal head shown in FIG. 14 is of a partially glazed type in which heating resistive elements are formed on an expanded glazed layer. According to such a structure, a recording head pressure acting on recording paper is increased so that a clear image can be recorded. This structure is different from the structure shown in FIG. 12 in that glazed layers 67-1 and 67-2 are partially formed in convexity on a substrate 66, and a resistive layer 30 is formed on the resultant structure. The resistive layer 30 is formed to match the height of the recording electrode 35 with that of the heating resistive element 30. The common electrode 61 and the separate electrodes 62 are formed on the resistive layer 30. The separate electrodes 62 have portions corresponding to the recording electrodes 35. In addition, a wear-resistant/insulating layer 63 is formed on the resistive layer 30 except on a region corresponding to recording electrode 35, thus manufacturing a recording head. According to this head, since the separate electrodes serve as the recording electrodes 35, the separate electrodes are made of a material having high wear resistance such as tungsten in advance.

Other embodiments wherein a thermal head and a current injection type recording head are formed on a single recording head will be described below with reference to FIGS. 15 and 16. In the embodiment described with reference to FIGS. 11 to 14, the thermal head and current injection type recording head are formed on a two-dimensional plane. However, in structures shown in FIGS. 15 and 16, a thermal head and a current injection type recording head are formed within the same section. According to the structure shown in FIG. 15, a recording electrode 35 is formed on a heating resistive element 30. A glazed layer 67 is formed on a substrate 66. A resistive layer 30 serving as a heating resistive element is formed on the resultant structure. A common electrode 61 and a separate electrode 62 are formed on the resistive layer 30 so as to form a thermal head portion first. A wear-resistant/insulating layer 63 is formed on the resultant structure. In this case, since the layer 63 do not need to have high wear resistance, and only maintenance of its insulating property is required, the layer 63 may be constituted by a thin insulating material. More specifically, a heat-resistant resin can be satisfactorily used as such a material. A conductor 62A serving as a current injection type recording electrode is formed on the resultant structure. This conductor 62A is directly formed as the recording electrode 35 and is brought into contact with an ink ribbon. Therefore, the conductor 62A is required to have high wear resistance. Note that since the same voltage may be applied to the conductor 62A serving as the recording electrode 35 and the separate electrode 62 of the the thermal head, both the electrodes are short-circuited outside the head or on the recording head (shown in FIG. 15). According to this recording head, heat generated by each heating resistive element is conducted to thermal paper or thermal ink transfer type ink ribbon through the insulating layer 63 and the conductive layer 62A. In current injection recording, since a projection of the conductor 62A is brought into contact with an ink ribbon for current injection recording, this projection serves as the recording electrode 35.

Figure 15:
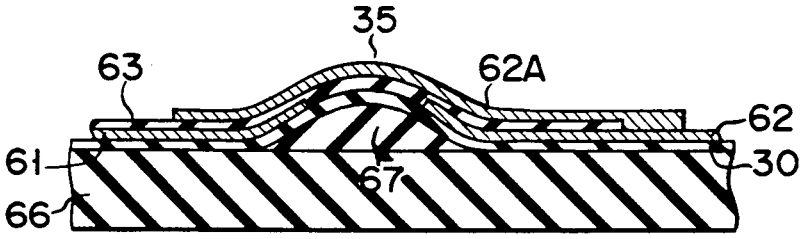
Figure 16:
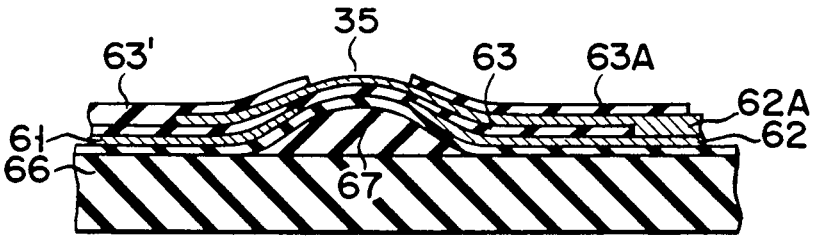

FIG. 16 shows a modification of the structure shown in FIG. 15. A wear-resistant/insulating layer 63A is formed on the conductor 62A so as to accurately set the resolution of recording electrodes. With this structure, the contact area to the ink ribbon of the recording electrodes in the subscan direction can be accurately set. In this case, the layer 63A is preferably made of a material having sufficiently high wear resistance as well as a good insulating property.

Figure 17:
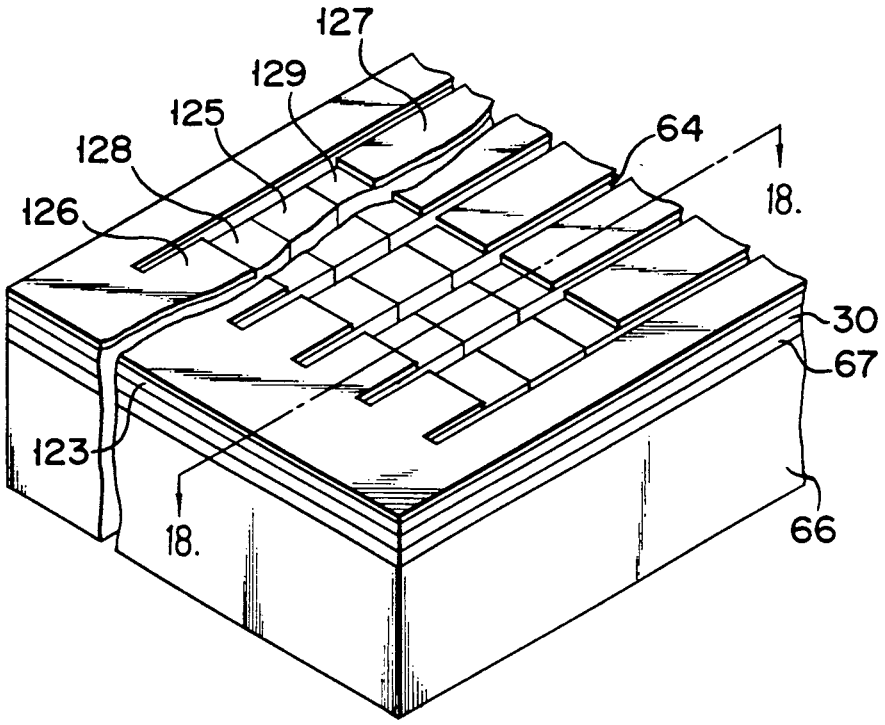
FIGS. 17 and 18 are a perspective view and a sectional view taken along a line A—A, respectively, showing a thermal recording head according to an another embodiment of the present invention.
Figure 18:
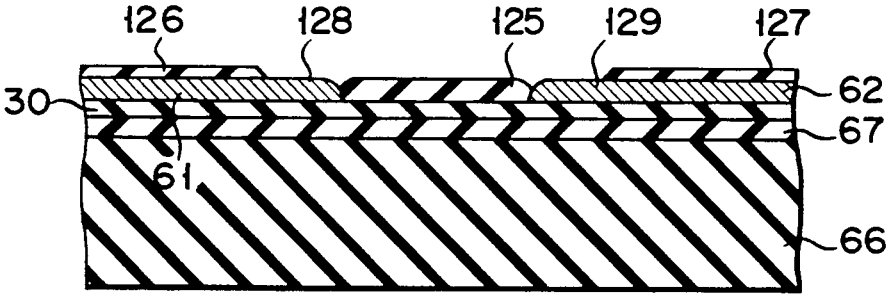

FIGS. 17 and 18 show a thermal recording head according to a sixth embodiment of the present invention. According to the thermal recording head shown in FIGS. 17 and 18, a heating resistive layer 30 is formed on an insulating substrate 66 having good heat resistance, such as a ceramic substrate, through a glazed layer 67 serving as a heat accumulating layer made of glass or the like. A common electrode 61 and a plurality of separate electrodes 62 are formed on the layer 30.

A wear-resistant layer 125 is formed on a partial heating area between the common electrode 61 and the separate electrodes 62 on the heating resistive layer 30. In addition, wear-resistant layers 126 and 127 are formed on portions of the common electrode 61 and the separate electrodes 62 other than portions 128 and 129 near the heating area. For example, $SiO_2$ films are used as the wear-resistant layers 125, 126, and 127. The heating resistive layer 30 is made of the same material as that of a conventional thermal head.

According to a normal thermal head which has been conventionally used, a wear-resistant layer is formed on the entire surface of a portion which is brought into contact with an ink ribbon. In contrast to this, in this thermal recording head, no wear-resistant layer is formed on the portions between the layers 125, 126, and 127. The common electrode 61 and the separate electrodes 62 are exposed at these portions, as indicated by reference numerals 128 and 129, and brought into direct contact with thermal paper or an ink ribbon. For this reason, electrodes 128 and 129 are made of a material having high wear resistance, such as tungsten unlike the conventional thermal head.

Figure 19A:
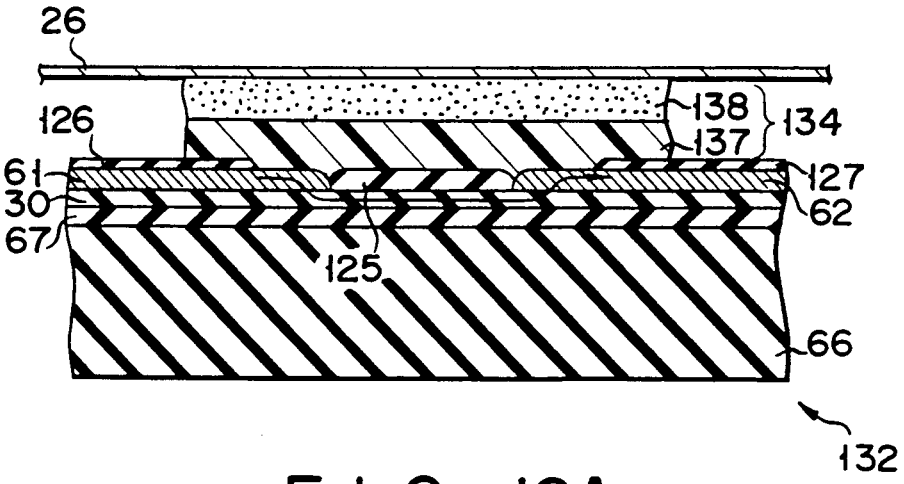
FIGS. 19A and 19B are sectional views for explaining an operation of the thermal recording head in FIGS. 17 and 18.
Figure 19B:
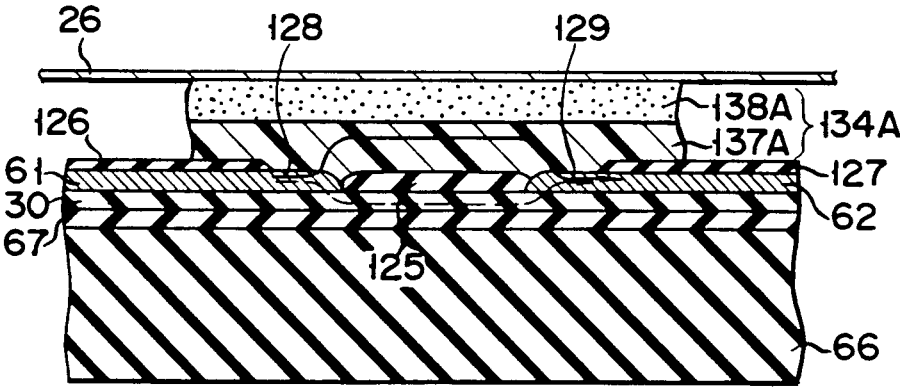

FIGS. 19A and 19B respectively show the flow of currents in thermal ink transfer recording and current injection recording in an apparatus using the thermal recording head shown in FIGS. 17 and 18.

In thermal ink transfer recording shown in FIG. 19A, an ink ribbon 134 having an ink layer 138 coated on a base film 137 is used. This ink ribbon 134 is urged against recording paper 26 by a thermal recording head 132. If a voltage is applied between a common electrode 61 and a separately electrode 62 at this time, a current flows from the common electrode 61 to the separate electrode 62 through a heating resistive layer 30. When the ink layer 138 coated on the ink ribbon 134 is heated by Joule heat which is generated when the current flows in the layer 30, an ink of the ink layer 138 is softened and transferred onto the recording paper 26 to form an image.

In current injection recording shown in FIG. 19B, an ink ribbon 134A having an ink layer 138A coated on a resistive base film 137A is used. When a thermal recording head 132 is urged against to the ink ribbon 134A, the ink ribbon 134A is also urged against to recording paper 26 and thermal recording head 132 is urged against, and a voltage is applied between a common electrode 61 and a separate electrode 62, a current flows along one of two types of paths indicated by solid and broken arrows. More specifically, in current injection recording, since the base film 137A of the ink ribbon 134A is resistive, a current flows from, e.g., an exposed portion 128 of the common electrode 61, which is in direct contact with the base film 137A, into the base film 137A, and further flows from a portion of the base film 137A which is in contact with an exposed portion 129 of the separate electrode 129 into the separate electrode 62, thus forming a current path. In this manner, the ink layer 138A is heated by Joule heat which is generated when the current flows in the resistive base film 137A, and the ink of the ink layer 138A is softened and transferred onto the recording paper 26 to form an image.

Note that the resistance of the resistive base film 137A is set to be smaller than that of a heating resistive layer 30 of the thermal recording head 132, i.e., to be half of or preferably 1/5 of that of the heating resistance layer 30 as described above. For this reason, most of the current flowing between the electrodes 123 and 124 flows through the resistive base film 137A as indicated by the solid arrow, but part of it flows through the heating resistive layer 30 along the path indicated by the broken arrow. In this case, Joule heat produced in the heating resistance layer 30 is applied as a heat-bias to the ink ribbon 134A to improve the sensitivity of the ink ribbon 134A.

As described above, the thermal recording head of the present invention can be used in the same manner as in the conventional thermal head in thermal paper recording or thermal ink transfer recording, as shown in FIG. 19A. In current injection recording, the thermal head of the present invention can be used in the same manner as in the conventional current injection recording head, as shown in FIG. 19B. Therefore, by using a single recording apparatus, the respective recording schemes, i.e., thermal paper recording, thermal ink transfer recording, and current injection recording can be arbitrarily selected in accordance with recording conditions.

Figure 20A:
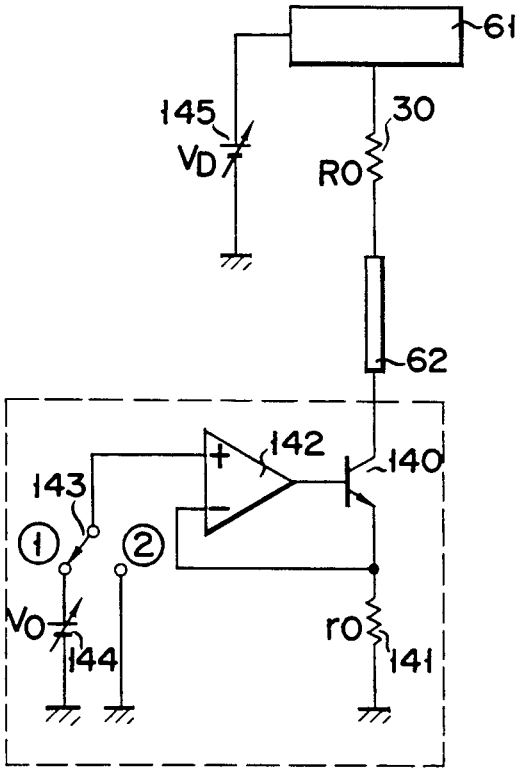
FIGS. 20A and 20B are equivalent circuits of circuits for driving the recording head of the present invention during thermal ink transfer type and current injection type thermal recording, respectively.
Figure 20B:
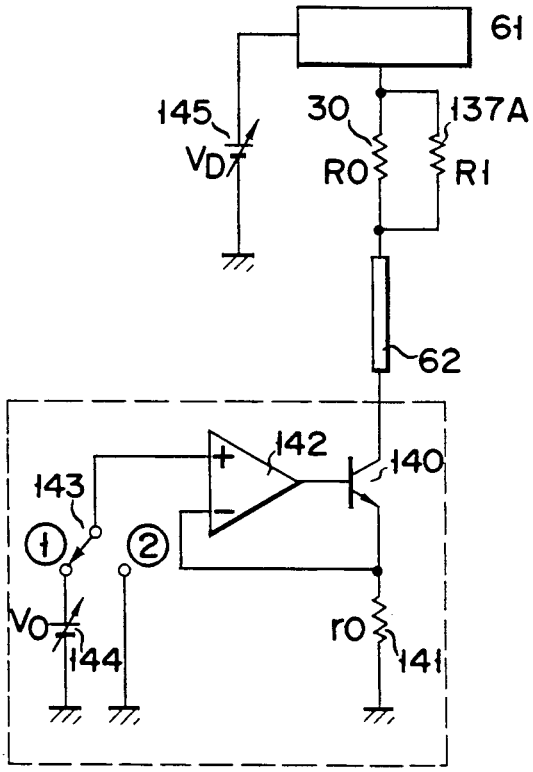

FIGS. 20A and 20B show detailed arrangements of driver circuits of the thermal recording apparatus according to the present invention. Normally, conventional thermal heads for thermal paper recording and thermal ink transfer recording are driven by constant-voltage drivers, and a recording head for current injection recording is driven by a constant-current driver. When current injection recording is performed at high speed, a contact resistance between an ink ribbon and each electrode may be greatly changed. As a result, an amount of heat generated in a resistive base film is changed by constant voltage driving. FIGS. 20A and 20B show cases of constant current driving.

Referring to FIGS. 20A and 20B, each portion enclosed by a broken line is a constant-current driver corresponding to a single separate electrode 24. FIG. 20A shows an equivalent circuit for thermal paper recording or thermal ink transfer recording. The constant-current driver comprises a transistor 140 for driving a separate electrode 62, a current monitor resistor 141 having a resistance $r_0$, an operational amplifier 142, a switching element 143, and a reference voltage source 144 for generating a voltage $V_0$. A common electrode 61 is connected to a drive voltage source 145 for generating a voltage $V_D$ and is connected to the separate electrode 62 through a heating resistive element 30 having a resistance $R_0$.

The switching element 143 is normally connected to a contact (2) side, and no current flows in the separate electrode 62. When the element 143 is connected to a contact (1) side only for a period of time during which a current is desired to flow in the separate electrode 62, and the reference voltage $V_0$ is applied to the non-inverting input terminal of the operational amplifier 142, a current flows in the separate electrode 62. The operational amplifier 142 controls a current flowing through the current monitor resistor 141 so as to set a voltage at the inverting input terminal to be equal to the reference voltage $V_0$ which is applied to the non-inverting input terminal. That is, a current $I_0$ for setting $V_0=r_0\times I_0$ flows in the monitor resistor 141. Since the collector current of the transistor 140 is substantially equal to its emitter current, the current $I_0$ also flows in the separate electrode 24, i.e., the heating resistive layer 30.

FIG. 20B shows an equivalent circuit for performing recording using an ink ribbon 134 for current injection recording. The function of the constant-current driver in this case is the same as that of the driver in the above case. However, the circuit in FIG. 20B is different from that in FIG. 20A in that in addition to a resistor $R_0$ of a heating resistive layer 30 between a common electrode and a separate electrode 62, a resistor $R_1$ of a resistive base film 137A is connected to the resistor $R_0$ in parallel.

In this case, when a reference voltage is equal to a voltage $V_0$, a current $I_0=V_0/r_0$ flows in a monitor resistor 141. Since the resistors $R_0$ and $R_1$ are parallel-connected, currents actually flowing through the resistors $R_0$ and $R_1$ correspond to values respectively divided thereby. Therefore, constant-current driving is not necessarily performed even by using the constant-current driver. However, this arrangement is advantageous in that an excessive current can be prevented from flowing in the ink ribbon 134A.

The resistor $R_1$ of the resistive base film 137A is smaller in value than the resistor $R_0$ of the heating resistive layer 30. For this reason, a larger amount of currents flow in the resistive base film 137A than in the heating resistive layer 30. Current injection recording characterized in that heat is generated near the ink layer 138A, and hence the heat can be efficiently transmitted to the ink layer 138A, thus realizing high-speed recording. By controlling the respective values of the resistors $R_0$ and $R_1$ so as to establish $R_0>R_1$, efficient current injection recording can be realized.

In the circuits of FIGS. 20A and 20B, the voltage $V_0$ of the reference voltage source 144 is variable because optimal current values may be varied in thermal paper recording, thermal ink transfer recording, and current injection recording. This is because the sensitivities and recording speeds of thermal paper, an ink ribbon for thermal ink transfer recording, and an ink ribbon for current injection recording are different from each other.

Furthermore, in the circuits of FIGS. 20A and 20B, the voltage $V_0$ of the drive voltage source 145 is variable. This is because if the load resistance of the circuit is changed when a current of an optimal current value flows in each recording scheme, a loss in the drive transistor 140 may be increased. If, for example, $R_0=1$ KΩ in the circuit of FIG. 20A, and a drive current of 30 mA is required, the drive voltage $V_0$ of about 30 V is required. However, in the circuit of FIG. 20B, as a load resistance is 500 Ω, and a current of 30 mA is required, if $R_1=1$ kΩ, the drive voltage $V_0$ of 15 V is enough.

If, therefore, the drive voltage $V_0$ is constantly set to be 30 V which is required in the circuit of FIG. 20A, a voltage of 15 V will be consumed as a collector loss in the transistor 40 in the circuit of FIG. 20B. Since this loss is converted into heat, formation of an IC is difficult. For this reason, the drive voltage $V_0$ is set to be variable as described above, and the voltage $V_0$ is lowered to about 15 V in the circuit of FIG. 20B, so that this loss is prevented by using the drive transistor 40 in a range near saturation.

As a method of setting the reference voltage $V_0$ and the drive voltage $V_0$ to be variable, a method of using, e.g., D/A converters as the reference voltage source 144 and the drive voltage source 145 can be employed. In this method, necessary analog voltages can be obtained by properly changing input values to the D/A converters using a CPU or the like.

FIGS. 20A and 20B show the constant-current drivers. It is apparent, however, that constant-voltage drivers can be used without departing the scope of the present invention.

In the above-described embodiments, a current flows from the common electrode 61 to the separate electrode 62. However, the same effects can be obtained even if a current flows in the opposite direction.

Furthermore, in the circuits of FIGS. 20A and 20B, the common electrode 61 side and the separate electrode 62 side are respectively connected to the positive power source and the ground potential. However, the same effects can be obtained even if the common electrode 61 is connected to the ground potential and the separate electrode 62 is connected to the negative electrode 62.

If the constant-current drivers having the arrangements shown in FIGS. 20A and 20B are used, a type of ink ribbon set in a cassette can be identified. More specifically, a known current which is too small for recording flows in each separate electrode 62 while the thermal recording head 132 is urged against an ink ribbon, so that a type of ink ribbon, i.e., a recording scheme can be discriminated by checking a potential difference between the common electrode 61 and the separate electrode 62. Assume that when a current flows without urging the thermal recording head 132 against an ink ribbon, a potential difference $V_1$ is generated between the common electrode 61 and the separate electrode 62, and that when a current flows with the thermal recording head 132 being urged against the ink ribbon, a potential difference of $V_2$ is generated. If $V_1=V_2$ at this time, an ink ribbon 134 for thermal ink transfer recording is set and the thermal ink transfer recording scheme is selected, or only thermal paper is set without setting ink ribbon and the thermal paper recording scheme is selected. If $V_1>V_2$, an ink ribbon 134A for current injection recording is set and the current injection recording scheme is selected.

Thermal recording heads according to seventh to tenth embodiments of the present invention will be described below with reference to FIGS. 21 to 24. The thermal recording head shown in FIG. 18 corresponds to a thermal head having a structure called a flat type. A flat type thermal head is advantageous in that its structure is simple, and hence can be easily manufactured. However, since the area where recording paper and an ink ribbon are in contact with the thermal recording head is large, the thermal head must be urged with a large force to increase a contact pressure. In order to solve this problem, a conventional thermal head sometimes employs a so-called partially glazed type structure.

Figure 21:
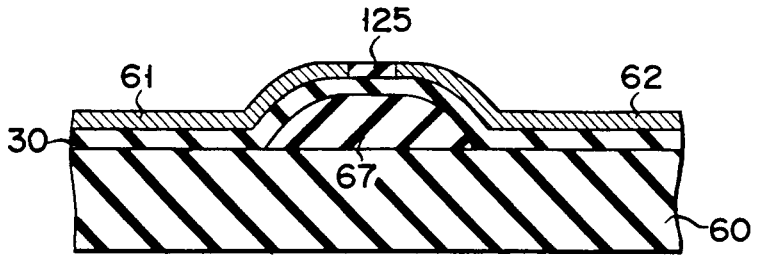
FIGS. 21 to 24 are sectional views showing thermal recording heads according to other embodiments of the present invention.

FIG. 21 shows the thermal recording head according to the seventh embodiment of the present invention. A portion of the thermal head has a structure corresponding to a partially glazed type. More specifically, this thermal recording head is designed such that a glazed layer 67 is formed on part of a substrate 60, and a heating resistive layer 30, a common electrode 61, and separate electrodes 62 are formed thereon. A wear-resistance layer 125 having an insulating property is embedded in a portion between separate electrodes 62 and the common electrode 61.

Similar to the recording head shown in FIG. 18, in the thermal recording head having such a structure, if an ink ribbon 134 for thermal ink transfer recording is used, a current flows from the common electrode 61 to one of the separate electrodes 62 through a heating resistive layer 30. If an ink ribbon 134A for current injection recording is used, a current path is formed to extend from the common electrode 61 to one of the separate electrodes 62 through a resistive base film 137A in addition to the above current path. In this embodiment, since each separate electrode 62 and the common electrode 61 are brought into direct/slidable contact with an ink ribbon, a material having high wear resistance, such as tungsten, must be used for these electrodes.

If the partially glazed structure shown in FIG. 21 is employed, since the area where recording paper and an ink ribbon are in contact with the thermal recording head is reduced as compared with that of the flat type head, the contact pressure between the ink ribbon and the recording paper can be increased with a small force. Therefore, a clear image can be recorded even on paper having a slightly rough surface. In addition, especially when thermal ink transfer recording or current injection recording is to be performed by using sublimable ink requiring a large pressure between an ink ribbon and recording paper, the partially glazed type recording head is advantageous in terms of image quality and recording speed.

Figure 22:
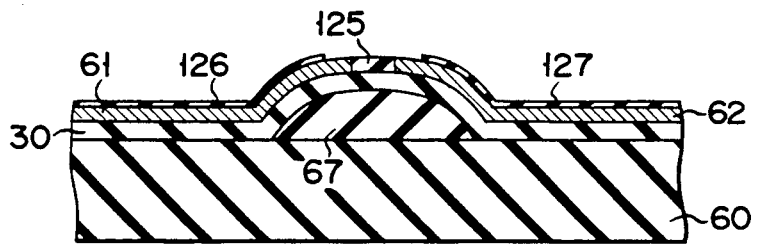

According to the thermal recording head of the eighth embodiment shown in FIG. 22, similar to the structure shown in FIG. 18, wear-resistant layers 126 and 127 are formed on a common electrode 61 and separate electrodes 62 so as to expose portions 128 and 129 near a heating area of a heating resistive layer 30 in addition to the structure of the thermal recording head shown in FIG. 21.

According to the thermal recording head of the eighth embodiment shown in FIG. 22, substantially only portions near projections of electrodes 61 and 62 are brought into contact with an ink ribbon. However, unnecessary portions of the electrodes 123 and 124 may be brought into contact with an ink ribbon because loosened or slackened due to mechanical defects. If an ink ribbon 134 for thermal ink transfer recording is used, no problem may not be posed. However, if an ink ribbon 134 for current injection recording is used, since currents flow from portions where the ink ribbon 134A is in contact with the electrodes 61 and 62, the size of an image dot size may be greatly changed, or discharge may occur when they are alternately brought into contact with each other and separated from each other, and the electrodes 123 and 124 may be damaged due to the discharge. If wear-resistant layers 126 and 127 are newly formed as shown in FIG. 6 so as to limit contact between the ink ribbon and the electrodes 123 and 124 to a projection corresponding to a glazed layer 67, such an undesirable state can be prevented.

Figure 23:
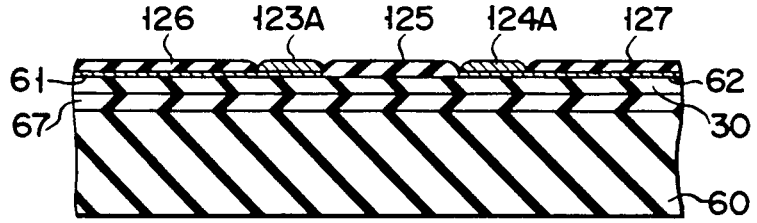
Figure 24:
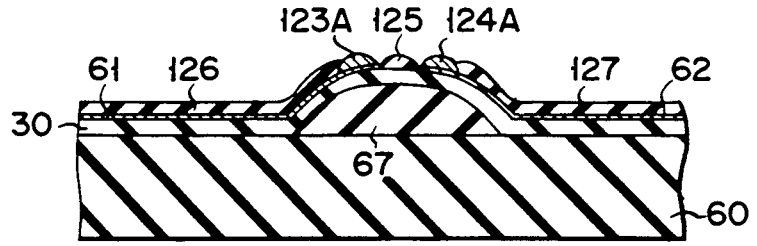

In the thermal recording heads shown in FIGS. 18, 21, and 22, a metal material having high wear resistance is used for the electrodes 123 and 124 in consideration of use for supply current recording. However, a metal material having high wear resistance, such as tungsten, cobalt, or nickel, is difficult to process. In addition, since such a metal material is expensive, if it is used in large amount, the cost of a recording head becomes high. FIG. 23 shows a thermal head designed to solve this problem.

According to the thermal recording head of the ninth embodiment shown in FIG. 23, a glazed layer 67 is formed on a substrate 60, and a heating resistive layer 30, a common electrode 61, and separate electrodes 62 are formed on the layer 67. The preceding formation steps are the same as thin film formation steps of forming a normal thermal head, and thin film electrodes made of a metal material having high conductivity, e.g., copper, can be satisfactorily used as the common electrode 61 and the separate electrodes 62. This is because, as is apparent from FIG. 23, the electrodes 61 and 62 are not brought into direct contact with an ink ribbon, and only exposed portions denoted by reference symbols 123A and 124A which are formed on the electrodes 61 and 62 are brought into contact with the ink ribbon.

The manufacturing steps for this thermal recording head will be described in detail below. Upon formation of the common and separate electrodes 61 and 62, a metal having high wear resistance is only formed on necessary portions by plating or the like using a mask so as to form the exposed portions 123A and 124A of the common and separate electrodes 61 and 62, which serve as contact portions with an ink ribbon. In the last step' insulating, wear-resistant layers 126 and 127 such as SiO2 films are formed on the resultant structure, thus completing the thermal recording head shown in FIG. 23.

As described above, in the thermal recording head shown in FIG. 23, an electrode material such as a metal or alloy material having wear resistance is used for only the exposed portions 123A and 124A of the common and separate electrodes 61 and 62, which are brought into contact with an ink ribbon. In addition, the manufacturing steps are simple. Therefore, the cost can be greatly reduced.

FIG. 23 shows the flat type thermal recording head. However, the same arrangement can be applied to a partially glazed type thermal recording head shown in FIG. 24.

As described above, according to the present invention, in a recording apparatus to be used for various purposes, such as a wordprocessor, a recording scheme can be arbitrarily selected from the thermal paper, thermal ink transfer, and current injection recording schemes in accordance with conditions of use.

In this manner, recording by means of the respective recording schemes, i.e., the thermal paper, thermal ink transfer, and current injection recording schemes can be selectively performed by a single thermal recording apparatus using a common thermal recording head. Therefore, the thermal paper recording scheme is employed for recording of a document having a large number of characters, and the thermal ink transfer recording scheme is employed for recording of a document having a small number of characters, thereby reducing the recording cost. In addition, when high-quality characters are required to be recorded on rough paper having a coarse surface at high speed, the current injection recording scheme may be employed.

What is claimed is:

1. A thermal recording apparatus for recording on either of thermal paper or plain paper in accordance with recording data, comprising:

recording mode determining means for determining one of a current injection mode and a thermal paper mode;

hold means for holding an ink ribbon including a resistive base film and an ink layer in the current injection mode, ink being transferred from the ink layer to the plain paper upon reception of heat generated in the resistive base film in the current injection mode;

means for feeding the ink ribbon held by said hold means in a predetermined direction;

heat generating means, having heating points for generating heat in accordance with recording data, for applying heat from the heating points to thermal paper in the thermal paper mode, said heat generating means being brought into contact with the thermal paper in the thermal paper mode and with the ink ribbon in the current injection mode to apply heat from the heating points to the ink ribbon; and current injection means, having electrodes and being brought into contact with the ink ribbon in the current injection mode, for injecting a current from the electrodes to the ink ribbon in accordance with recording data so as to supply a current to the ink ribbon and to generate heat in the resistive base film of the ink ribbon in the current injection mode, said heat generating means being located at an upstream side of said current injecting means with respect to the predetermined direction in which the ink ribbon is fed.

2. An apparatus according to claim 1, wherein the ink ribbon is detachably mounted on said holding means.

3. An apparatus according to claim 2, further comprising second hold means for holding and conveying one of thermal paper and plain paper.

4. An apparatus according to claim 3, further comprising selecting means for selecting one of the thermal paper mode and the current injection mode, and supplying a signal current to one of said heat generating means and said current injecting means to energize the selected one.

5. An apparatus according to claim 4, further comprising detecting means for generating a first loading signal by detecting whether one of the papers is held by said second hold means, generating a second loading signal by detecting whether the ink ribbon is loaded in said first hold means, said selecting means selecting one of the modes in response to the first and second loading signal.

6. An apparatus according to claim 4, wherein said selecting means includes constant voltage generating means for generating a constant voltage and applying the constant voltage to said heat generating means, and constant current generating means for generating a constant current and supplying the constant current to said current injecting means.

7. An apparatus according to claim 1, wherein said heat generation means and said current injecting means are formed as a single structure.

8. An apparatus according to claim 1, further comprising a return electrode which is brought into contact with the ink ribbon in the current injection mode to collect currents supplied from said current injection means to the ink ribbon.

9. A thermal recording apparatus according to claim 1, wherein the ink ribbon further includes a conductive film provided between the resistive base film and the ink layer.

10. A thermal recording apparatus for recording on a plain paper in accordance with recording data, comprising:

recording mode determining means for determining one of a thermal ink transfer mode and a current injection mode;

hold means for holding one of first and second ink ribbons in accordance with the determined one of the thermal ink transfer and current injection modes, the first ink ribbon including a base film and an ink layer, the second ink ribbon including a resistive base film and an ink layer, and ink being transferred from one of the ink layers to the plain paper upon reception of heat;

means for feeding one of said first and second ink ribbons held by said hold means in a predetermined direction;

heat generating means, having heating points for generating heat in accordance with recording data, for applying heat from heating points to the first ink ribbon in the thermal ink transfer mode, said heat generating means being brought into contact with said first ink ribbon in the thermal ink transfer mode to apply heat from the heating points to said first ink ribbon; and current supply means, having electrodes and being brought into contact with the second ink ribbon in the current injection mode, for injecting a current from the electrodes to the second ink ribbon in accordance with recording data so as to supply a current to said second ink ribbon and to generate heat in the resistive base film of said second ink ribbon in the current injection mode, said heat generating means being located at an upstream side of said current supply means with respect to the predetermined direction in which second ink ribbon is fed.

11. An apparatus according to claim 10, wherein the first and second ink ribbons are detachably mounted on said holding means.

12. An apparatus according to claim 11, further comprising second hold means for holding and conveying the plain paper.

13. An apparatus according to claim 12, further comprising selecting means for selecting one of the thermal ink transfer mode and the current injection mode, and supplying a signal current to one of said heat generating means and said current injecting means to energize the selected one.

14. An apparatus according to claim 13, further comprising detecting means for generating a first loading signal by detecting whether the paper is held by said second hold means, generating a second loading signal by detecting whether one of the ink ribbons is loaded in said first hold means, and generating a discrimination signal for discriminating a type of the ink ribbons, said selecting means selecting one of the modes in response to the loading signal and the discrimination signal.

15. An apparatus according to claim 13, wherein said selecting means includes constant voltage generating means for generating a constant voltage and applying the constant voltage to said heat generating means, and constant current generating means for generating a constant current and supplying the constant current to said current injecting means.

16. An apparatus according to claim 10, wherein said heat generation means and said current injecting means are formed as a single structure.

17. An apparatus according to claim 10, further comprising a return electrode which is brought into contact with the ink ribbon in the cucrrent injection mode to collect currents supplied from said current injection means to the ink ribbon.

18. A thermal recording apparatus for recording on a plain paper in accordance with recording data comprising:

means for determining one of a thermal ink transfer mode and a current injection mode;

hold means for holding one of first and second ink ribbons in accordance with the determined one of the thermal ink transfer and current injection modes, the first ink ribbon including a base film and an ink layer, the second ink ribbon including a resistive base film and an ink layer, ink being transferred from one of the ink layers to the plain paper upon reception of heat in the thermal ink transfer mode or the current injection mode;

means for feeding one of the ink ribbons held by said hold means in a predetermined direction;

heat generating means, having heating points for generating heat in accordance with recording data and being brought into contact with the ink ribbon, for applying heat from the heating points to the ink ribbon so that the determined one of the first and second ink ribbons is heated in the thermal ink transfer mode and the determined one the first and second ink ribbons is preheated in the current injection mode; and current injecting means, having electrodes and being brought into contact with the preheated ink ribbon in the current injection mode, for injecting a current from the electrodes into the preheated ink ribbon in accordance with recording data so as to supply a current to the ink ribbon and to generate heat in the resistive base film of the ink ribbon.

19. An apparatus according to claim 18, wherein the ink ribbon is detachably mounted on said holding means.

20. An apparatus according to claim 18, further comprising second hold means for holding and conveying plain paper.

21. An apparatus according to claim 20, further comprising selecting means for selecting the current injection mode, and supplying a signal current to said heat generating means and said current injecting means to energize the selected one.

22. An apparatus according to claim 21, further comprising detecting means for generating a first loading signal by detecting whether paper is held by said second hold means, generating a second loading signal by detecting whether the ink ribbon is loaded in said first hold means, and said selecting means selecting the current injection mode in response to the first and second loading signal.

23. An apparatus according to claim 21, wherein said selecting means includes constant voltage generating means for generating a constant voltage and applying the constant voltage to said heat generating means, and constant current generating means for generating a constant current and supplying the constant current to said current injecting means.

24. An apparatus according to claim 18, wherein said heat generating means and said current injecting means are formed as a single structure.

25. An apparatus according to claim 18, further comprising a return electrode which is brought into contact with the ink ribbon in the current injection mode to collect currents supplied from said current injection means to the ink ribbon.

26. A thermal recording apparatus according to claim 18, wherein the ink ribbon further includes a conductive film provided between the resistive base film and the ink layer.

27. A thermal recording apparatus capable of recording on either thermal paper or plain paper in accordance with recording data, comprising:

means for determining one of a thermal paper mode and a current injection mode;

hold means for holding an ink ribbon including a resistive base film and a ink layer in the current injection mode, ink being transferred from the ink layer to the plain paper upon reception of heat generated in the resistive base film in the current injection mode;

means for feeding the ink ribbon held by said hold means in a predetermined direction;

head means for being brought in contact with one of the thermal paper and the current injection type ink ribbon, including:

an insulating substrate structure;

a resistive layer formed on said substrate structure;

a common electrode having one end portion and formed on said resistive layer; and a plurality of separate electrodes formed on said resistive layer and having one end portions which are closely arranged at the one end portion of said common electrode with a predetermined gap and separately extending on said resistive layer, current flowing through a first current path in the resistive layer of said head means between the common electrode and the separate electrodes to apply a heat generated from the resistive layer of said head means to the thermal paper in the thermal paper mode and flowing through a second current path in the current injection type ink ribbon between the one end portion of said common electrode and the one end portions of said separate electrodes to generate heat in the current injection type ink ribbon in the current injection mode, the resistance of the first current path being larger than that of the second current path.

28. An apparatus according to claim 27, wherein the ink ribbon is detachably mounted on said holding means.

29. An apparatus according to claim 27, further comprising second hold means for holding and conveying the plain paper.

30. An apparatus according to claim 29, further comprising selecting means for selecting one of the thermal paper mode and the current injection mode, and supplying a signal current to one of a heat generating means for applying heat to the thermal paper in the thermal paper mode and for preheating the ink ribbon in the current injection mode and current injecting means for injecting a current into the preheated ink ribbon to energize the selected one.

31. An apparatus according to claim 30, further comprising detecting means for generating a first loading signal by detecting whether the plain paper is held by said second hold means, for generating a second loading signal by detecting whether the ink ribbon is loaded in said hold means, and generating a discrimination signal for discriminating between the ink ribbon and the plain paper, said selecting means selecting one of the thermal paper and current injection modes in response to the loading signal and the discrimination signal.

32. An apparatus according to claim 30, wherein said selecting means includes constant voltage generating means for generating a constant voltage and applying the constant voltage to said heat generating means, and constant current generating means for generating a constant current and supplying the constant current to said current injecting means.

33. A thermal recording apparatus for recording on one of a thermal paper and a plain paper in accordance with recording data, comprising:

means for determining one of a thermal paper mode and a current injection mode;

hold means for holding an ink ribbon including a resistive base film and a ink layer in a current injection mode, ink being transferred from the ink layer to the plain paper upon reception of heat generated in the resistive base film in the current injection mode;

means for feeding the ink ribbon held by said hold means in a predetermined direction;

heat generating means, having heating points for generating heat in accordance with recording data and being brought in contact with one of the ink ribbon and the thermal paper, for applying heat from the heating points to the thermal paper in the thermal paper mode and for applying heat from the heating points to the ink ribbon so that the ink ribbon is preheated in the current injection mode; and current injecting means, having electrodes and being brought into contact with the preheated ink ribbon in the current injection mode, for injecting a current from the electrodes into the preheated ink ribbon in accordance with recording data so as to supply a current to the ink ribbon and to generate heat in the resistive base film of the ink ribbon.

34. An apparatus according to claim 33, wherein the ink ribbon is detachably mounted on said holding means.

35. An apparatus according to claim 34, further comprising detecting means for generating a first loading signal by detecting whether one of the papers is held by said second hold means, generating a second loading signal by detecting whether the ink ribbon is loaded in said first hold means, and said selecting means selecting the current injection modes in response to the first and second loading signal.

36. An apparatus according to claim 33, further comprising second hold means for holding and conveying one of thermal paper and plain paper.

37. An apparatus according to claim 36, wherein said selecting means includes constant voltage generating means for generating a constant voltage and applying the constant voltage to said heat generating means, and constant current generating means for generating a constant current and supplying the constant current to said current injecting means.

38. A thermal recording apparatus according to claim 37, wherein the ink ribbon further includes a conductive film provided between the resistive base film and the ink layer.

39. An apparatus according to claim 33, further comprising selecting means for selecting the current injection mode, and supplying a signal current to said heat generating means and said current injecting means to energize the selected one.

40. A thermal recording apparatus according to claim 33, wherein the ink ribbon further includes a conductive film provided between the resistive base film and the ink layer.

41. A thermal recording apparatus capable of recording on a plain paper in accordance with recording data, comprising:

means for determining a current injection transfer mode;

hold means for holding an ink ribbon including a resistive base film and an ink layer in the current injection mode, ink being transferred from the ink layer to the plain paper upon reception of heat generated in the resistive base film in the current injection mode;

means for feeding the ink ribbon held by said hold means in a predetermined direction;

collecting means, being brought in contact with the current injection type ink ribbon, for collecting a current; and head means being brought in contacting with the current injection type ink ribbon in the current injection mode, including:

an insulating substrate structure;

a resistive layer formed on said substrate structure;

a common electrode having one end portion and formed on said resistive layer; and a plurality of separate electrodes formed on said resistive layer and having one end portions which are closely arranged at the one end portion of said common electrode with a predetermined gap and separately extending on said resistive layer, current flowing through a first current path in the resistive layer between the common electrode and the separate electrodes and flowing through a second current path in the current injection type ink ribbon between the one end portions of said separate electrodes and said collecting means in the current injection modes, the resistance of the first current path being larger than that of the second current path.

42. An apparatus according to claim 41, further comprising second hold means for holding and conveying the plain paper.

43. An apparatus according to claim 42, further comprising selecting means for selecting the current injection mode, and supplying a signal current to a heat generating means for preheating the ink ribbon in the current injection mode and a current injecting means for injecting a current into the preheated ink ribbon to energize the selected one.

44. An apparatus according to claim 42, further comprising detecting means for generating a first loading signal by detecting whether the paper is held by said second hold means, generating a second loading signal by detecting whether the ink ribbon is loaded in said first hold means, and said selecting means selecting the current injection mode in response to the first and second loading signal.

45. An apparatus according to claim 42, wherein said selecting means includes constant voltage generating means for generating a constant voltage and applying the constant voltage to said heat generating means, and constant current generating means for generating a constant current and supplying the constant current to said current injecting means.

46. A thermal recording head for applying heat to one of a thermal paper in a thermal paper mode and a thermal ink transfer type ink ribbon in a heat generating mode, and applying a current to a current injection type ink ribbon in a current injection mode, comprising:

an insulating substrate structure;

a resistive layer formed on said substrate structure;

a common electrode having one end portion and formed on said resistive layer;

a plurality of separate electrodes formed on said resistive layer and having one end portions which are closely arranged at the one end portion of said common electrode with a predetermined gap, and separately extending on said resistive layer; and a wear-resistant layer formed on said resistive layer and the common electrode, heat being generated in the resistive layer between the common electrode and the separate electrodes and transferred through said wear-resistance layer to the one of the thermal paper and the thermal ink transfer type ink ribbon in the heat generating mode and a current flowing the current injection type ink ribbon through the one end portions of said separate electrodes in the current injection mode.

47. A head according to claim 46 further comprising means for bringing said wear-resistant layer and one end portion of each of said common and separate electrodes into contact with a corresponding one of the thermal paper and the thermal ink transfer ink ribbon and the current injection ink ribbon, respectively in accordance with one of the thermal paper mode and the heat generating mode and the current injection mode.

48. A head according to claim 46, further comprising means for generating a discrimination signal for discriminating one of the heat, generating and current injection modes by detecting a current flowing between said common and separate electrodes.

49. A head according to claim 46, wherein said substrate structure includes a heat accumulating layer for accumulating heat generated in said resistive layer.

50. A head according to claim 46, further comprising a first segment electrode formed on and projected from one end portion of said common electrode and a second segment electrode formed on and projected from each of said separate electrodes.

51. A thermal recording head for applying heat to one of a thermal paper and a thermal ink transfer ink ribbon in a thermal paper mode and heat generating mode, respectively, and applying a current to a current injection ink ribbon in a current injection mode, comprising:

an insulating substrate structure;

a resistive layer formed on said substrate structure;

a common electrode having one end portion and formed on said resistive layer;

a plurality of separate electrodes formed on said resistive layer and having one end portions which are closely arranged at the one end portion of said common electrode with a predetermined gap, and separately extending on said resistive layer; and a wear-resistant layer formed on said resistive layer, said common electrode except the one end portion and said plurality of separate electrodes except the one end portions, heat being generated in the resistive layer between the one end portion of said common electrode and the one end portions of said separate electrodes and transferred through said wear-resistance layer to the one of the thermal paper in the thermal paper mode and the thermal ink transfer type ink ribbon in the heat generating mode and a current flowing to the current injection type ink ribbon through the one end portions of said common electrode and the separate electrodes in the current injection mode.

52. A head according to claim 51, further comprising means for bringing said wear-resistant layer and one end portion of each of said common and separate electrodes into contact with a corresponding one of the thermal paper and the thermal ink transfer ink ribbon and the current injection ink ribbon, respectively in accordance with one of the thermal paper mode and the heat generating mode and the current injection mode.

53. A head according to claim 51, further comprising means for generating a discrimination signal for discriminating the current injection mode by detecting a current flowing between said common and separate electrodes.

54. A head according to claim 51, wherein said substrate structure includes a heat accumulating layer for accumulating heat generated in said resistive layer.

55. A head according to claim 51, further comprising a first segment electrode formed on and projected from one end portion of said common electrode and second segment electrodes formed on and projected from each of said separate electrodes.

56. A thermal recording head for applying heat to one of a thermal paper in a thermal paper mode and a thermal ink transfer type ink ribbon in a heat generating mode, and applying a current to a current injection type ink ribbon in a current injection mode, comprising:

an insulating substrate structure;

a resistive layer formed on said substrate structure;

a common electrode having one end portion and formed on said resistive layer;

a plurality of first separate electrodes formed on said resistive layer and having one end portions which are closely arranged at the one end portion of said common electrode with a predetermined gap, and separately extending on said resistive layer;

a wear-resistant layer formed on said resistive layer, the common electrode, and the first separate electrodes, heat being generated in the resistive layer between the common electrode and the first separate electrodes and transferred through the wear-resistant layer to the one of the thermal paper and the thermal ink transfer type ink ribbon in the heat generating mode; and a plurality of second separate electrodes formed on said wear-resistant layer, having one end portions and electrically connected to said first separate electrode, a current being injected into the current injection type ink ribbon from the one end portions of said second separate electrodes in the current injection mode.

57. A head according to claim 56, further comprising means for bringing said wear-resistant layer and one end portion of each of said common and second separate electrodes into contact with a corresponding one of thermal paper and the thermal ink transfer ink ribbon and the current injection ink ribbon, respectively in accordance with one of the thermal paper mode and the heat generating mode and the current injection mode.

58. A head according to claim 56, wherein said substrate structure includes a heat accumulating layer for accumulating heat generated in said resistive layer.

59. A head according to claim 56, further comprising a first segment electrode formed on and projected from one end portion of said common electrode and second segment electrodes formed on and projected from each of said second separate electrodes.

60. A thermal recording head for applying heat to one of a thermal paper and a thermal ink transfer type ink ribbon in a thermal paper mode and a heat generating mode, respectively, and applying a current to a current injection type ink ribbon in a current injection mode, comprising:

an insulating substrate structure;

a resistive layer formed on said substrate structure;

a first common electrode having one end portion and formed on said resistive layer;

a plurality of first separate electrodes formed on said resistive layer and having one end portions which are closely arranged at the one end portion of said common electrode with a predetermined gap, and separately extending on said resistive layer;

a wear-resistant layer formed on said resistive layer, first common electrode and first separate electrodes, heat being generated in the resistive layer between the first common electrode and the first separate electrodes and transferred through the wear-resistant layer to one of the thermal paper in the the thermal paper mode and to the thermal ink transfer type ink ribbon in the heat generating mode;

a second common electrode having one end portion electrically connected to said first common electrode; and a plurality of second separate electrodes having one end portions which are closely arranged at the one end of said second common electrode with a predetermined gap, separately extending and electrically connected to said first separate electrodes, current being injected into the current injection type ink ribbon from the one end portions of said second common electrode and the one end portions of said second separate electrodes in the current injection mode.

61. A head according to claim 60, further comprising means for bringing said wear-resistant layer and one end portion of each of said second common and second separate electrodes into contact with a corresponding one of thermal paper and the ink ribbon in accordance with one of the thermal paper mode and the heat generating mode and the current injection mode.

62. A head according to claim 60, wherein said substrate structure includes a heat accumulating layer for accumulating heat generated in said resistive layer.

63. A head according to claim 60, further comprising a first segment electrode formed on and projected from one end portion of said second common electrode and a second segment electrode formed on and projected from each of said second separate electrodes.

64. A thermal recording apparatus for recording on a plain paper in accordance with recording data, comprising:

means for determining one of a thermal ink transfer mode and a current injection transfer mode;

hold means for holding one of first and second ink ribbons in accordance with the determined one of the thermal ink transfer and current injection modes, the first ink ribbon including a base film and an ink layer, the second ink ribbon including a resistive base film and an ink layer, ink being transferred from one of the ink layer to the plain paper upon reception of heat in the thermal ink transfer mode or current injection mode;

means for feeding one of the first and second ink ribbons held by said hold means in a predetermined direction;

head means for being brought in contact with one of the first and second ink ribbons, including:

an insulating substrate structure;

a resistive layer formed on said substrate structure;

a common electrode having one end portion and formed on said resistive layer; and a plurality of separate electrodes formed on said resistive layer and having one end portions which are closely arranged at the one end portion of said common electrode with a predetermined gap and separately extending on said resistive layer, current flowing through a first current path in the resistive layer of said head means between the common electrode and the separate electrodes to apply a heat generated from the resistive layer of said head means to the paper in the thermal ink transfer mode and flowing through a second current path in the second ink ribbon between the one end portion of said common electrode and the one end portions of said separate electrodes to generate a heat in the second ink ribbon in the current injection mode, the resistance of the first current path being larger than that of the second current path.

65. A thermal recording apparatus for recording on one of a thermal paper and a plain paper in accordance with recording data, comprising:

means for determining one of a thermal paper mode and a current injection mode;

hold means for holding a current injection type ink ribbon including a resistive base film and an ink layer in a current injection mode, ink being transferred from the ink layer to the plain paper upon reception of heat generated in the resistive base film in the current injection mode;

means for feeding the current injection type ink ribbon held by said hold means in a predetermined direction;

collecting means, being brought in contact with the current injection type ink ribbon, for collecting a current; and head means being brought in contact with the current injection type ink ribbon in the current injection mode and the thermal paper in the thermal paper mode, including:

an insulating substrate structure;

a resistive layer formed on said substrate structure;

a common electrode having one end portion and formed on said resistive layer; and a plurality of separate electrodes formed on said resistive layer and having one end portions which are closely arranged at the one end portions of said common electrode with a predetermined gap and separately extending on said resistive layer, current flowing through a first current path in the resistive layer between the common electrode and the plurality of separate electrodes in the thermal paper mode and flowing a second current path in the current injection type ink ribbon between the one end portions of said separate electrodes and said collecting means in the current injection mode, the resistance of the first current path being larger than that of the second current path.

* * * * *